US005192000A

United States Patent [19]

Wandrick et al.

[11] Patent Number: 5,192,000

[45] Date of Patent: Mar. 9, 1993

[54] BEVERAGE DISPENSER WITH AUTOMATIC RATIO CONTROL

[75] Inventors: Lisa C. Wandrick, Decatur; George H. Hoover, Marietta; Roger C. Whigham, Atlanta; John H. Bearden, Marietta, all of Ga.

[73] Assignee: The Coca-Cola Company, Atlanta, Ga.

[21] Appl. No.: 739,742

[22] Filed: Aug. 2, 1991

Related U.S. Application Data

[63] Continuation-in-part of Ser. No. 522,627, May 14, 1990, abandoned.

[51] Int. Cl.[5] ..... B67D 5/08

[52] U.S. Cl. ..... 222/59; 222/63; 222/129.3; 222/132; 222/135; 222/144.5

[58] Field of Search ..... 222/52, 54, 55, 59, 222/60, 63, 129.1, 129.2, 129.3, 129.4, 132, 134, 135, 136, 144.5, 640, 641

[56] References Cited

U.S. PATENT DOCUMENTS

| | | | |
|---|---|---|---|
| 3,195,780 | 7/1965 | Garland et al. | 222/134 |
| 3,272,217 | 9/1966 | Young | 137/101.19 |
| 3,439,552 | 4/1969 | King et al. | 137/635 X |
| 3,474,815 | 10/1969 | Beahm et al. | 137/101.19 |
| 3,604,419 | 9/1971 | Diskin et al. | 222/55 X |
| 3,650,434 | 3/1972 | Johnson et al. | 222/31 |
| 3,768,510 | 10/1973 | Reves | 222/30 X |
| 3,783,899 | 1/1974 | Fowler et al. | 239/66 X |
| 3,838,797 | 10/1974 | Nelson | 222/134 |
| 3,948,419 | 4/1976 | Polster | 222/61 |
| 3,999,686 | 12/1976 | Kato | 222/39 |
| 4,020,977 | 5/1977 | Hechler, IV | 222/145 |
| 4,202,387 | 5/1980 | Upton | 222/54 X |
| 4,234,007 | 11/1980 | Titone et al. | 137/101.19 |
| 4,246,969 | 1/1981 | McLoughlin et al. | 222/55 X |
| 4,281,777 | 8/1981 | Akens | 222/134 |
| 4,487,333 | 12/1984 | Pounder et al. | 222/129.4 X |
| 4,559,831 | 12/1985 | Prestele | 73/861.05 |
| 4,708,266 | 11/1987 | Rudick | 222/129.1 X |
| 4,815,632 | 3/1989 | Ball et al. | 222/23 |
| 4,821,925 | 4/1989 | Wiley et al. | 222/129.4 |
| 4,876,653 | 10/1989 | McSpadden et al. | 222/55 X |
| 4,884,720 | 12/1989 | Whigham et al. | 222/54 |
| 4,967,808 | 11/1990 | Credle, Jr. et al. | 222/2 X |
| 4,979,639 | 12/1990 | Hoover et al. | 222/59 X |
| 5,012,955 | 5/1991 | Shannon | 222/129.1 X |
| 5,033,644 | 7/1991 | Tentler | 222/63 X |
| 5,038,971 | 8/1991 | Gayer et al. | 222/55 X |

*Primary Examiner*—Andres Kashnikow
*Assistant Examiner*—Joseph A. Kaufman
*Attorney, Agent, or Firm*—Thomas R. Boston; W. Dexter Brooks

[57] ABSTRACT

An automatic ratio control system for a single or multi-flavor post-mix beverage dispensing valve of a beverage dispenser including a flow meter in each syrup and water conduit, a temperature sensor in each syrup conduit, an adjustable flow control in each syrup and water conduit, an automatic flow control adjuster, and an electronic control system including a microprocessor and appropriate software for adjusting a particular flow control when a measured flow rate falls outside of a range of preferred flow rates.

15 Claims, 38 Drawing Sheets $$\text{STEPS} = \left(\frac{\text{ACTUAL FLOWRATE} - \text{TARGET FLOWRATE}}{(\Delta\text{FLOWRATE/REVOLUTION})}\right) \times \frac{\text{STEPS}}{\text{REVOLUTION}}$$

DIRECTION CLOCKWISE OR POSITIVE FOR NEGATIVE ERROR

DIRECTION COUNTER-CW OR NEGATIVE FOR POSITIVE ERROR

B) THERE HAS BEEN A SETTINGS VALUE CHANGED

C) MESSAGE TO PASS THRU TO COKEBUS

D) RESPOND TO REQUEST FROM ROM (POWER)

BEVERAGE DISPENSER WITH AUTOMATIC RATIO CONTROL

CROSS-REFERENCE TO RELATED APPLICATION

This is a continuation-in-part to U.S. patent application Ser. No. 07/522,627, filed May 14, 1990, now abandoned having the same title and assigned to the same assignee as this case.

BACKGROUND OF THE INVENTION

This invention relates to post-mix beverage dispensers and in particular to a beverage dispensing valve system providing automatic ratio control.

SUMMARY OF THE INVENTION

Monitoring and testing of mechanical flow controls for beverage dispensing valves such as that known as the piston/sleeve or pressure compensating flow control presently used on dispensing valves to control the ratio of the syrup to water of the beverage dispensed from the dispensing valve tend to drift out of adjustment after a period of time such as between one to four weeks. In the past, it has been necessary for restaurant or service personnel to daily or weekly test for ratio accuracy and to then manually set the flow controls if they were found to be out adjustment. The automatic ratio control system of the present invention is capable of monitoring and adjusting the flow controls on an ongoing basis, with no interaction from personnel. The present invention uses flow meters such as, for example, a paddle wheel pulse type flow meter, positioned in each of the liquid supply tubing to continuously monitor the flow rate of each liquid and also includes an automatic adjusting mechanism, aptly termed the electronic screwdriver, that can make adjustments to the flow control, such as at the time that a flow error trend is detected. Data from the individual liquid lines (including the carbonated water or soda line, the plain water line and the individual syrup lines) is retained in the memory of a microprocessor from several recent pours in order to analyze and interpret a flow trend error. This technology can be adapted and retrofitted for any single or multiflavor valve that uses adjustable flow controls.

In a preferred embodiment of the present invention the present invention includes a mechanical flow control adjuster that includes a stepper motor and a movable carriage with a solenoid that locates the flow control to be corrected and then performs the adjustment thereon, hardware and software to monitor the flow meters and detect flow trend errors and then to control the adjuster mechanism. The present invention includes several major components: (1) a flow control adjuster mechanism; (2) flow meters which are placed in the syrup and water lines before or after the cooling device and which then send information (which may be electronic pulses) to the control system based on the flow rate; (3) control system including the hardware and the software.

It is an object of the present invention to provide an improved post-mix beverage dispenser which includes means for automatically controlling the ratio of syrup to water in the dispensed beverage.

It is another object of the present invention to provide a method and apparatus for controlling the ratio of syrup to water in a beverage dispenser.

It is another object of the present invention to provide a beverage dispensing valve system including one or more single and/or multiflavor valves, with means for automatically monitoring and controlling the ratio of syrup to water in each of the beverages dispensed therefrom.

It is another object of the present invention to provide a beverage dispensing valve system with a mechanically adjustable flow control, a flow meter in each of the liquid lines and a microprocessor for automatically energizing the flow control adjuster whenever the measured flow rate falls outside of a preferred flow rate.

BRIEF DESCRIPTION OF THE DRAWINGS

The present invention will be more fully understood from the detailed description below when read in connection with the accompanying drawings wherein like reference numerals refer to like elements and wherein.

DETAILED DESCRIPTION OF THE PREFERRED EMBODIMENT

Figure 1:
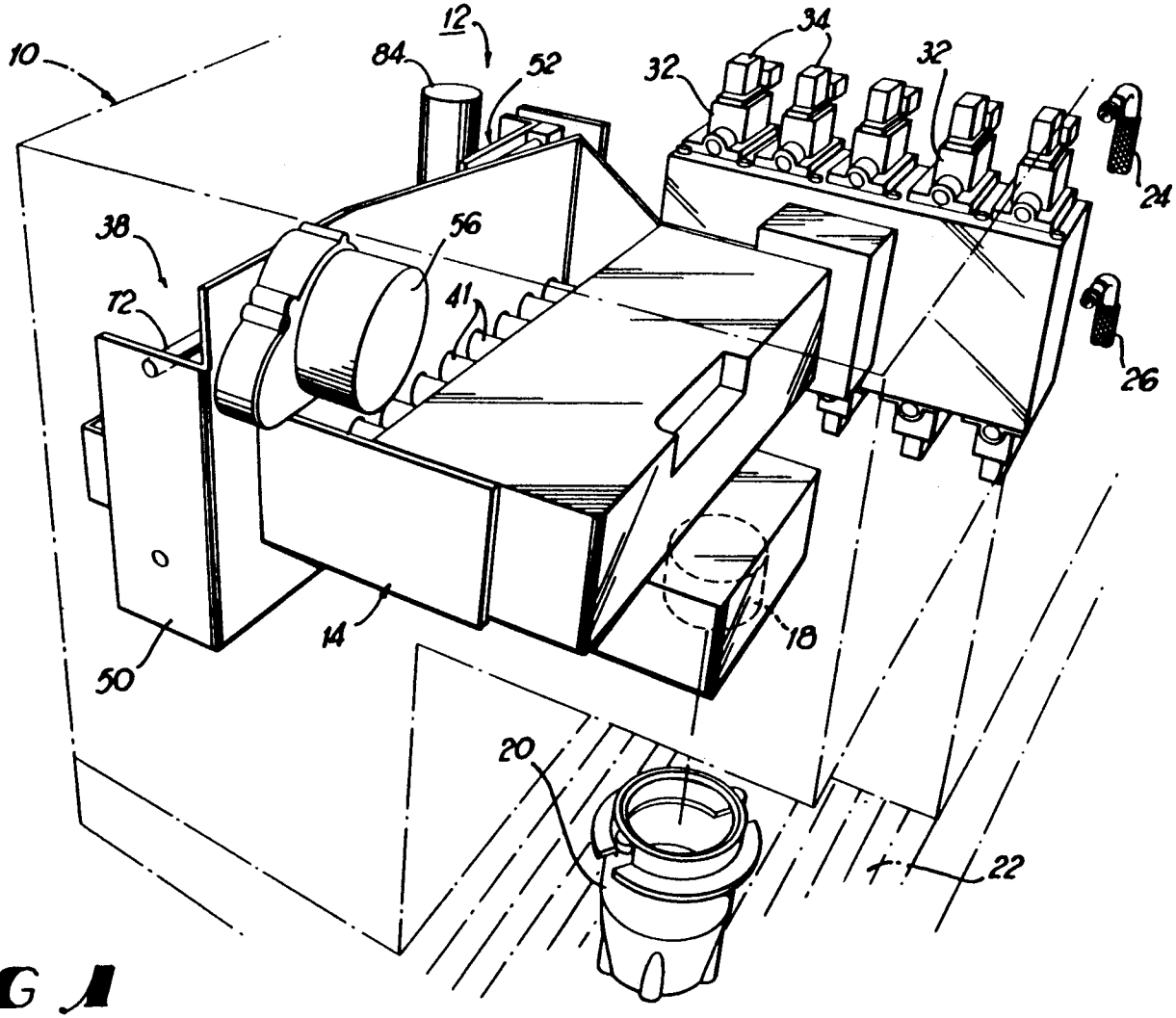
FIG. 1 is a partial perspective view of a post-mix beverage dispenser showing a beverage dispensing valve system according to one embodiment of the present invention.
Figure 2:
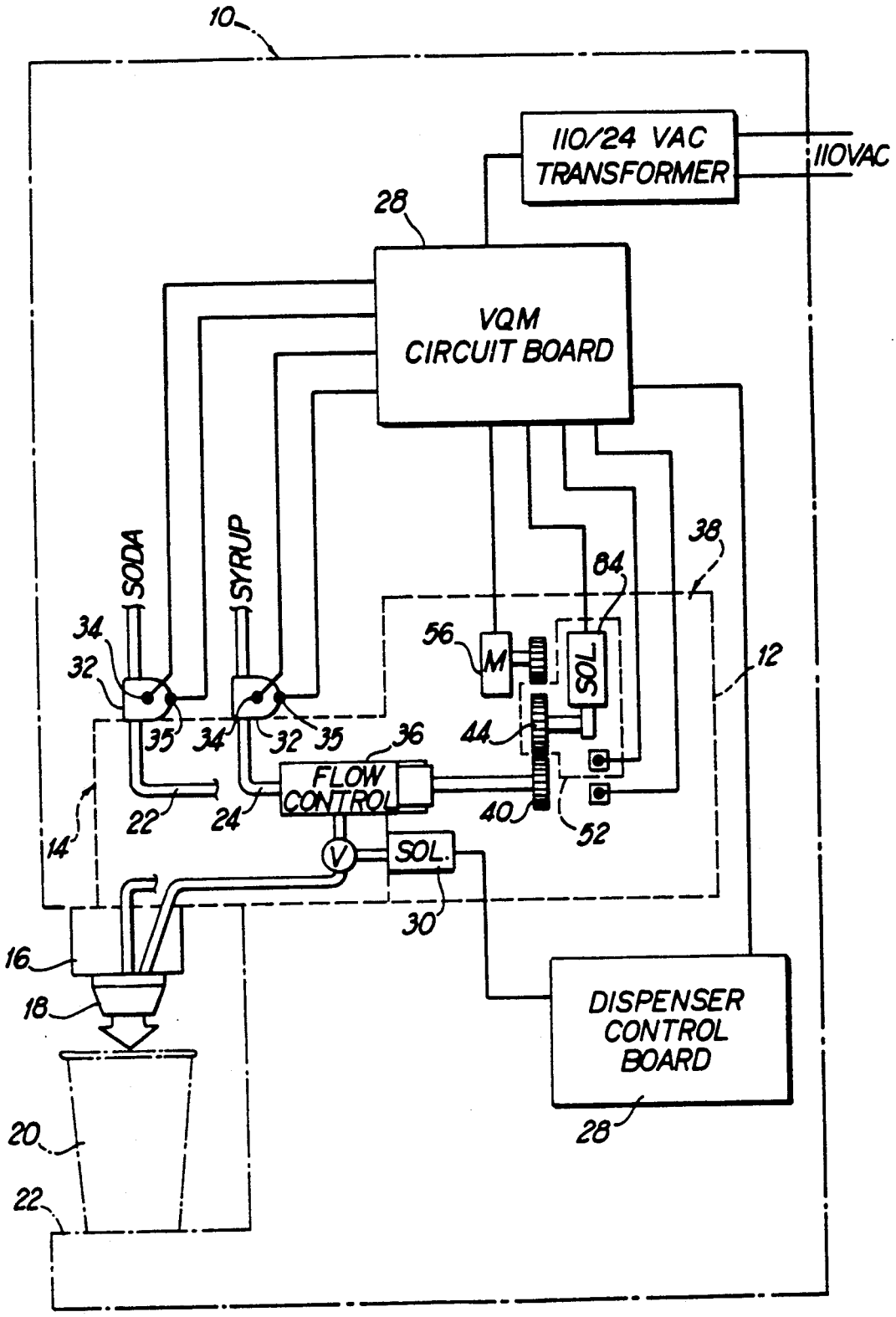
FIG. 2 is a partly diagrammatic, partly schematic diagram of the present invention.

With reference now to the drawings, FIGS. 1 and 2 show a post-mix beverage dispenser 10 according to the present invention having an automatic ratio control system 12 for controlling the ratio of syrup to water in the beverage dispensed therefrom.

The dispenser 10 includes a dispensing valve 14 including a nozzle 16 and spout 18 for dispensing a beverage into a cup 20 positioned on a cup rest 22. The valve 14 and nozzle 16 are preferably a multiflavor valve and nozzle and the dispenser 10 includes a plurality of syrup lines (one of which is shown at 24) and a soda (carbonated water) line 26. There is an inlet water line to the dispenser and both a soda line and a plain water line to the valve 14. Various known features of a dispenser, such as the carbonator and refrigeration system, are not described herein in detail.

In the preferred embodiment, the valve 14 is an eight flavor valve and thus ten liquid conduits or lines are used, including eight syrup lines, one soda line and one plain water line.

The automatic ratio control system 12 includes the valve 14 and the electronic system 28. The valve 14 includes eight syrup conduits (one of which 24 is shown), a soda conduit 26, a plain water conduit, a solenoid controlled on-off valve 30 in each conduit, a flow meter 32 in each conduit, a temperature sensor 34 in at least each syrup conduit, an adjustable flow control 36 in each conduit, and a mechanical flow control adjuster 38.

The automatic ratio control system of this invention includes means for measuring the flow rate through each conduit (the flow meters 32 and temperature sensors 34), means for automatically comparing the measured flow rates with preferred ranges of flow rates (the electronic system 28), and means for automatically adjusting the flow controls at appropriate times. The flow meters 32 can be of any type such as paddle wheel flow meters with flow sensors 35 for sensing rotation of the paddle wheels.

The preferred embodiment of the automatic flow control adjuster 38 will now be described, followed by a description of the electronic system 28.

The automatic flow control adjuster 38 includes a flow control sprocket wheel 40 connected through a shaft 41 to each of the flow controls 36 and a movable actuator 42 for controllably rotating a selected one of the sprocket wheels 40. The sprocket wheels are preferably arranged in a linear array and may or may not be equally spaced apart.

The movable actuator 42 includes a single drive sprocket 44, positioning means 46 for moving the drive sprocket into mating contact with any selected one of the flow control sprockets, and drive means 48 for turning the drive sprocket and in turn the selected flow control sprocket, a desired amount.

The movable actuator 42 will now be described in detail with reference to FIGS. 1–6. The actuator 42 includes a stationary support 50 and a movable carriage 52 mounted for sliding movement thereon and carrying the single drive sprocket 44. The drive sprocket 44 is moved out of mating engagement with a flow control sprocket wheel 40 when the carriage is moved by the positioning means and when the carriage movement is completed, the drive sprocket 44 is then moved into mating engagement with the selected flow control sprocket at which time the drive means 48 can turn the selected flow control sprocket wheel the desired amount.

The stationary support 50 includes the linear array of flow control sprocket wheels 40, a stepper motor 56, a drive chain 58, a chain movement sensor 60 including a toothed wheel 61 and a photosensor 62 to read movement of the wheel and therefore of the chain, a locking rail 64 with a plurality of locking pin detents 66 to lock the carriage 52 in place in any one of a number of selected positions, a position rail 68 with a plurality of position holes 70 for locating a selected position, a plurality of carriage guide rods 72, and a home position photodetector 74.

The movable carriage 52 includes a carriage body 76, a plurality of guide blocks 78 slidably mounting the carriage on the guide rods 72, the drive sprocket 44 rotatably mounted on a drive sprocket axle 80 which in turn is connected to a vertically movable slide 82 having an upper carriage travel position and a lower flow control adjusting position, a solenoid 84 which when energized moves the slide up to its carriage travel positions against the action of a bell crank return spring 86, a position seeking photodetector 88 positioned to sense said position holes 70 in said position rail, a home position sensor tab 90, a locking pin 92 mounted on a locking pin slide 94, a bell crank 96 pivotably movable about a pivot shaft 98 and having a locking pin slide cam 100 and a cam slot 102 for the drive sprocket slide 82. In addition, a drive belt locking lug 104 is mounted above the drive sprocket to hold the drive chain thereto when the solenoid 84 is energized so the carriage 52 will move with the drive chain 58. A pair of idler rollers 106 guides the chain onto the drive sprocket. A pair of springs 108 bias the locking pin slide 94 downwardly.

Figure 3:
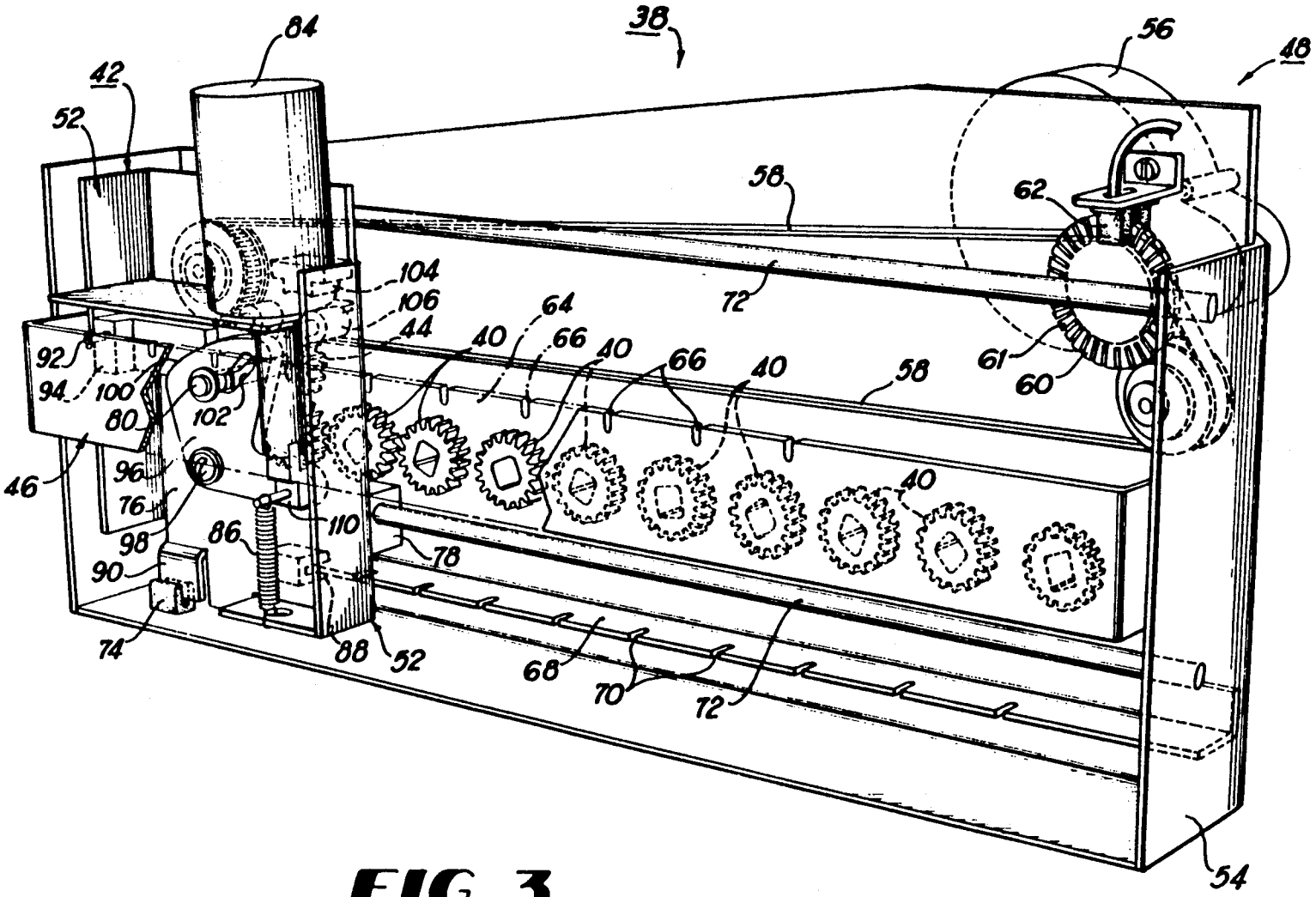
FIG. 3 is a perspective view of the flow control adjusting mechanism of this invention.

Thus, in operation, the carriage is preferably positioned at its home position with the drive sprocket 44 in mating engagement with the left most flow control sprocket wheel (as viewed in FIG. 3). When the electronic system 28 determines that a particular flow control should be adjusted a certain amount, the solenoid 84 is energized causing the solenoid armature 110 to pull up rotating the bell crank 96 and first raising the slide 94 to move the locking pin 92 out of the detent 66 and then raising the slide 82 to move the drive sprocket 44 away from a sprocket wheel and holding the drive chain 58 to the drive sprocket.

The stepper motor 56 is then energized to move the drive chain and thus the carriage 52 until the carriage reaches the desired location as sensed by the position seeking photodetector 88. The solenoid 84 is then de-energized to lock the carriage in place and to move the drive sprocket 44 into mating engagement with the flow control sprocket wheel 40 of the selected flow control 36 to be adjusted. The further movement of the drive chain 58 as controlled by the electronic system rotates the flow control sprocket wheel the amount determined to be necessary to adjust the flow controlled thereby. The turning of the flow control sprocket wheel adjusts the flow control in the same manner as done manually in the prior art by a screwdriver, and thus such need not be described here. The amount of rotation is determined by the following data: (1) 1 full rotation of the flow control equals "X" oz/sec. flow rate change, (2) 1 full rotation equals "Y" stepper motor steps, and (3) present flow rate minus desired flow rate equals "Z" oz/sec. Then the appropriate number of steps are relayed to the stepper motor. The toothed wheel 61 detects a flow control that is full in or full out to send an error message.

Figure 4A:
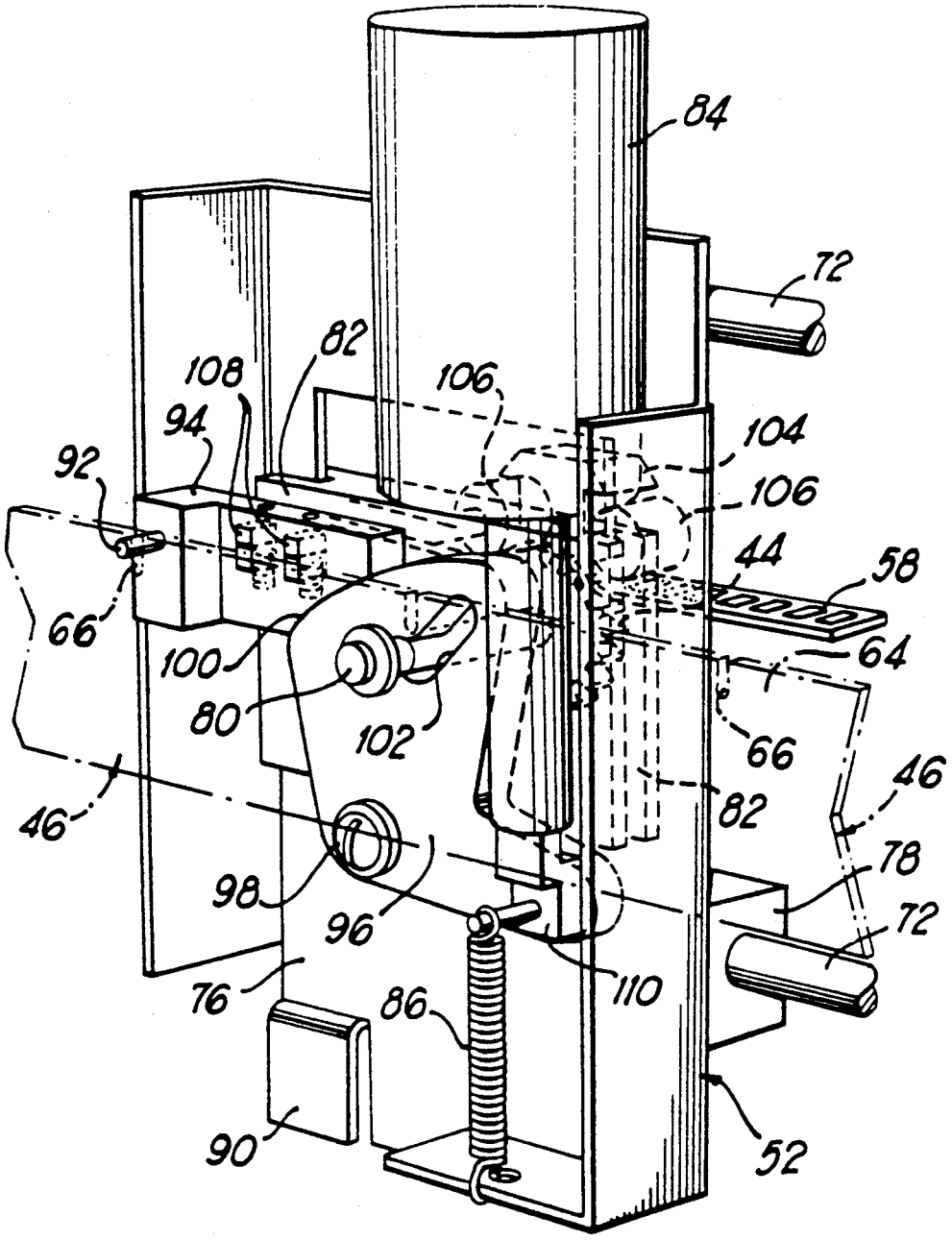
FIG. 4 is an enlarged perspective view of the movable carriage of the flow control adjusting mechanism, with FIGS. 4A, 4B and 4C showing different positions of the movable elements thereof as the solenoid is energized.
Figure 4B:
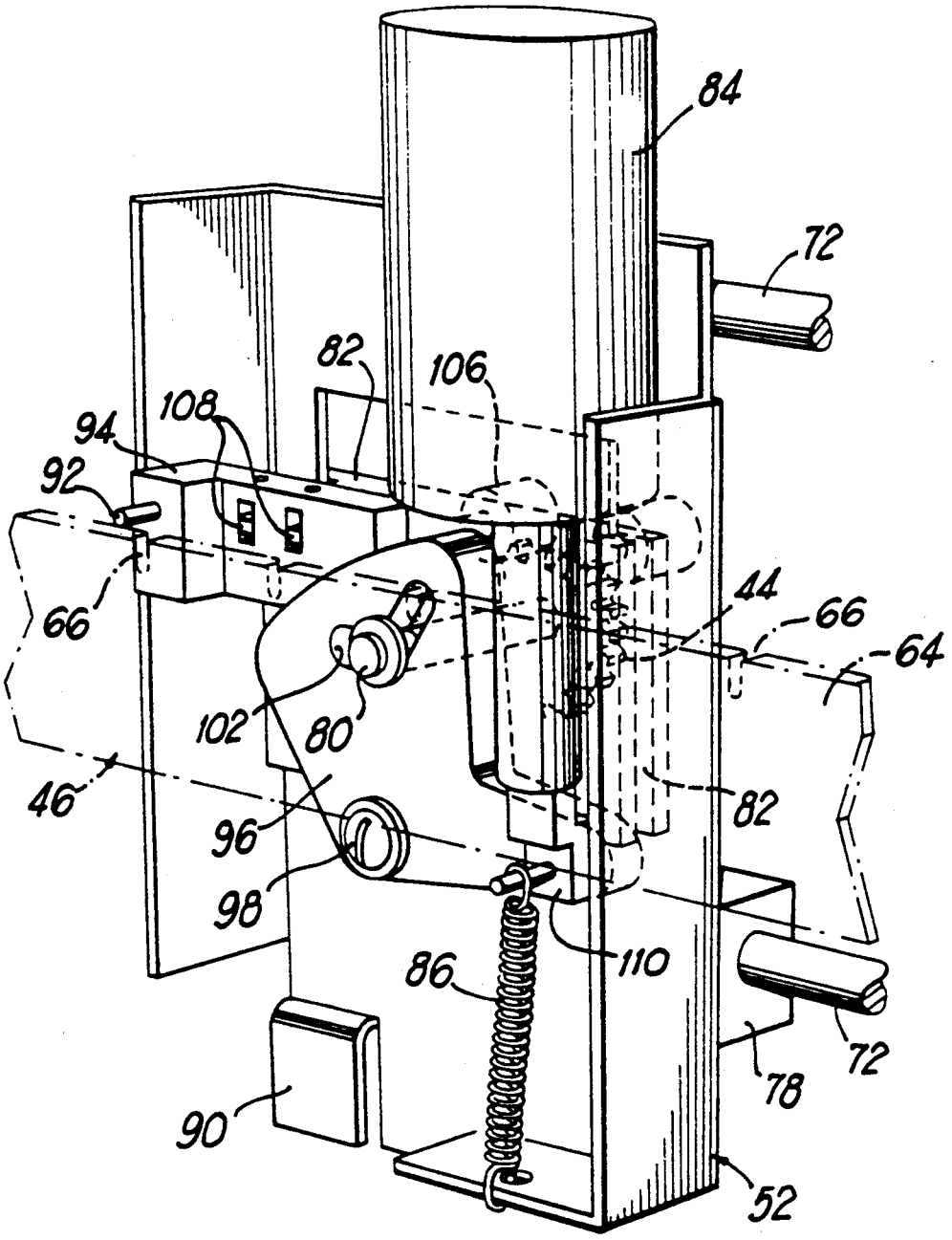
Figure 4C:
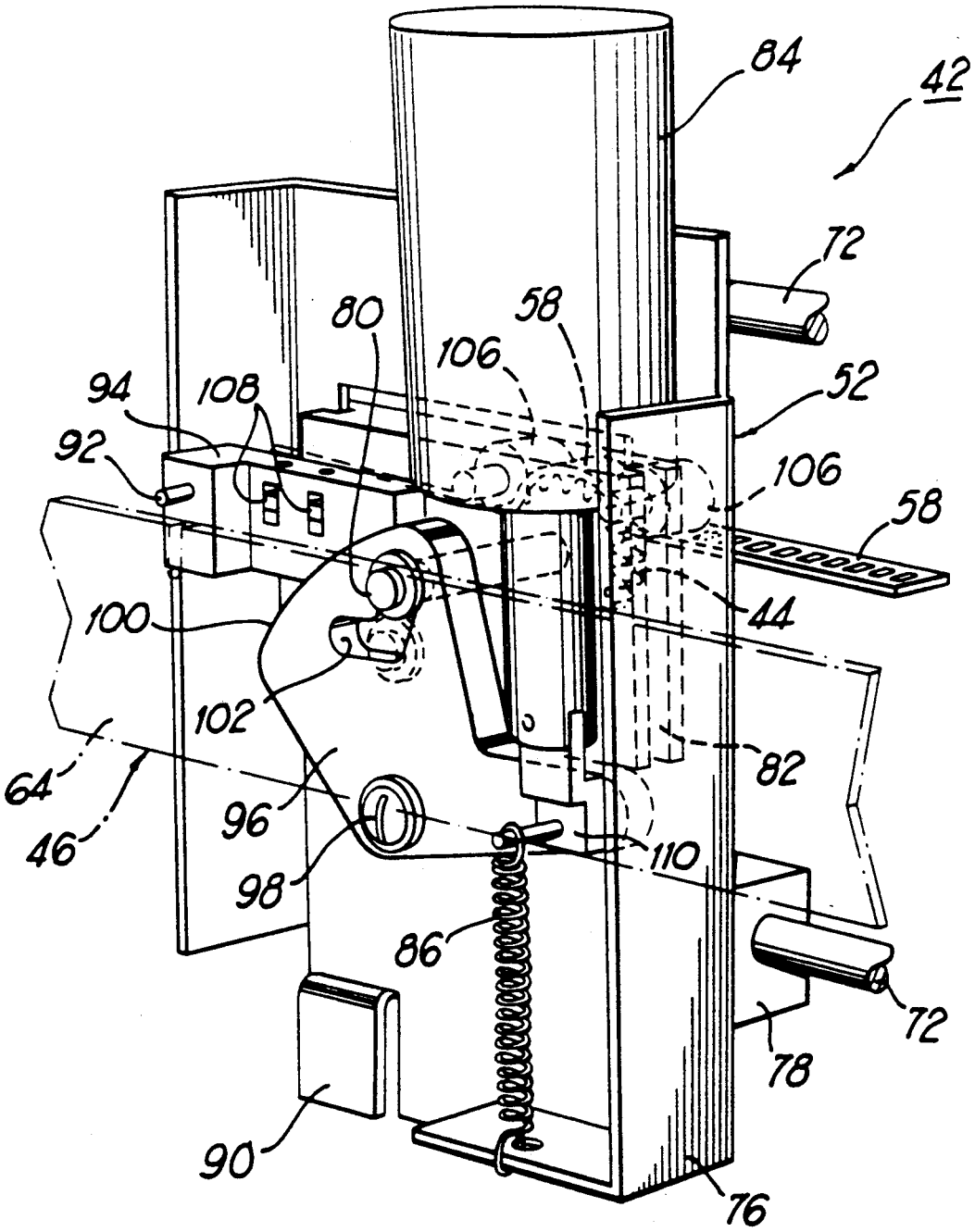
Figure 5:
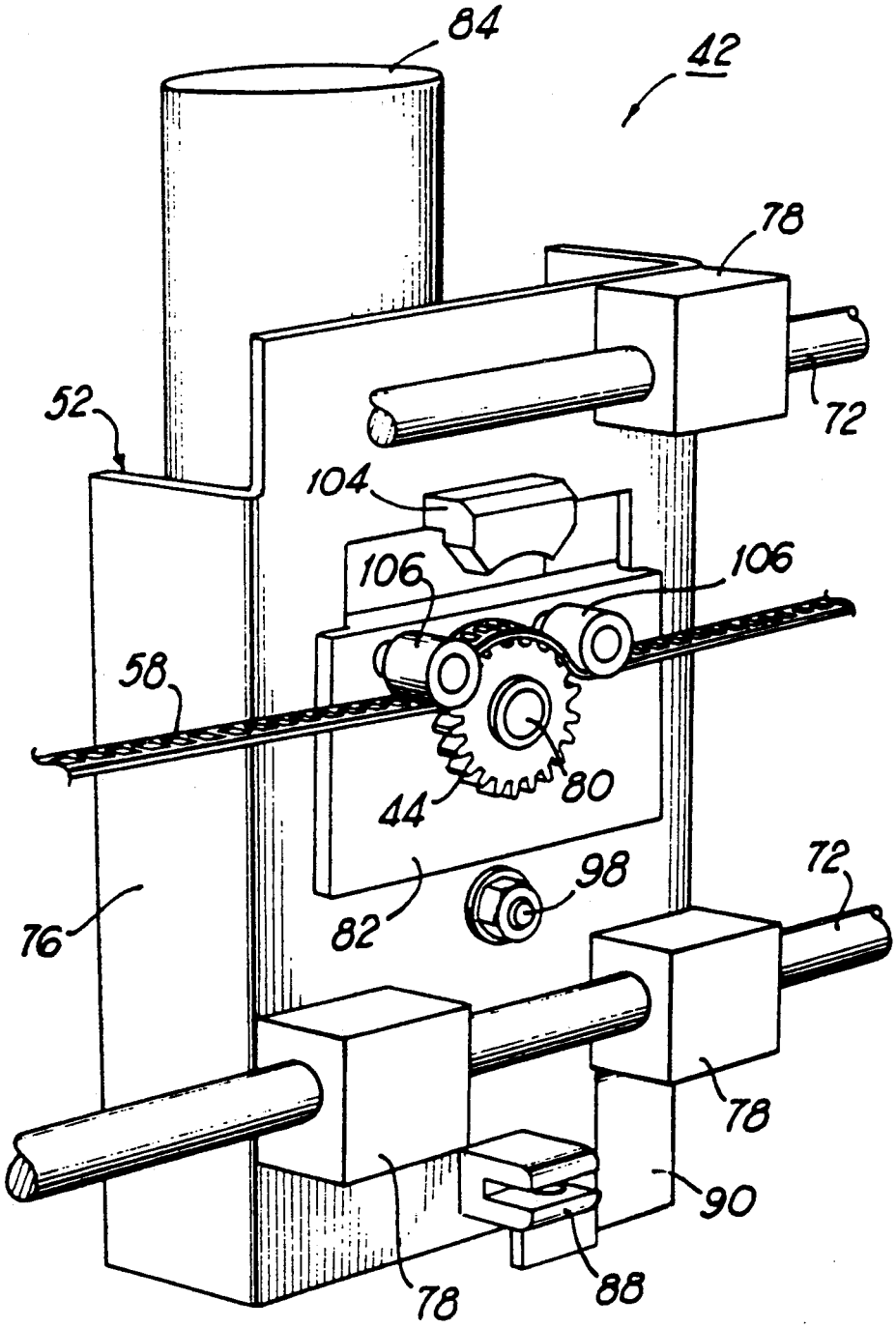
FIG. 5 is an enlarged rear view of the movable carriage of FIG. 4.
Figure 6:
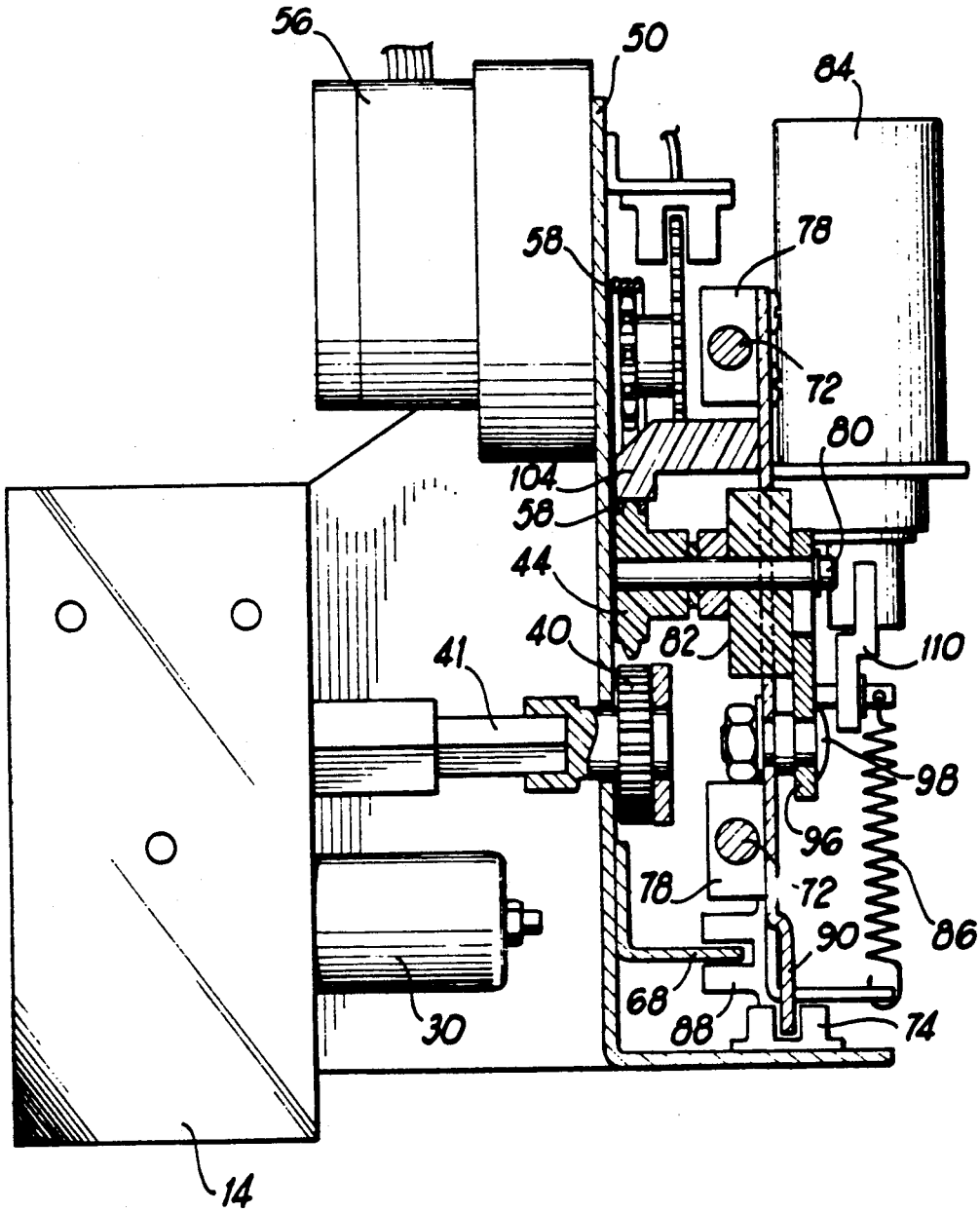
FIG. 6 is an end view of the flow control adjusting mechanism of FIGS. 3–5.

FIGS. 4A, 4B and 4C show the positions of the various elements as the solenoid 84 is energized and begins to turn the bell crank 96. FIG. 4A shows the various positions of the elements when the solenoid is not energized and FIG. 4C shows the various positions of the elements after they have completed their movement. FIG. 4B shows the positions of the various elements after the bell crank has moved about half way through its rotation. It is noted that the locking pin 92 is completely disengaged from the locking pin detents in the rail 64 before the drive sprocket moves up and holds the drive belt against the lug 104.

The electronic control system of this invention will be evident to anyone skilled in the art by reference to FIGS. 7–12 which show the software and the electronic schematics. However, for the benefit of those not skilled in the art, the following additional explanation may be of benefit. With reference first to FIGS. 7-10, upon power up, the electronic control system of this invention, hereinafter the VQM (or valve quality monitor), sets status bytes to request information about the type of equipment it is connected to and the beverage line information (what syrup is running through which line). It also receives information concerning the desired ratio settings and flow rates as well as whether the beverage is carbonated or not.

Figure 10:
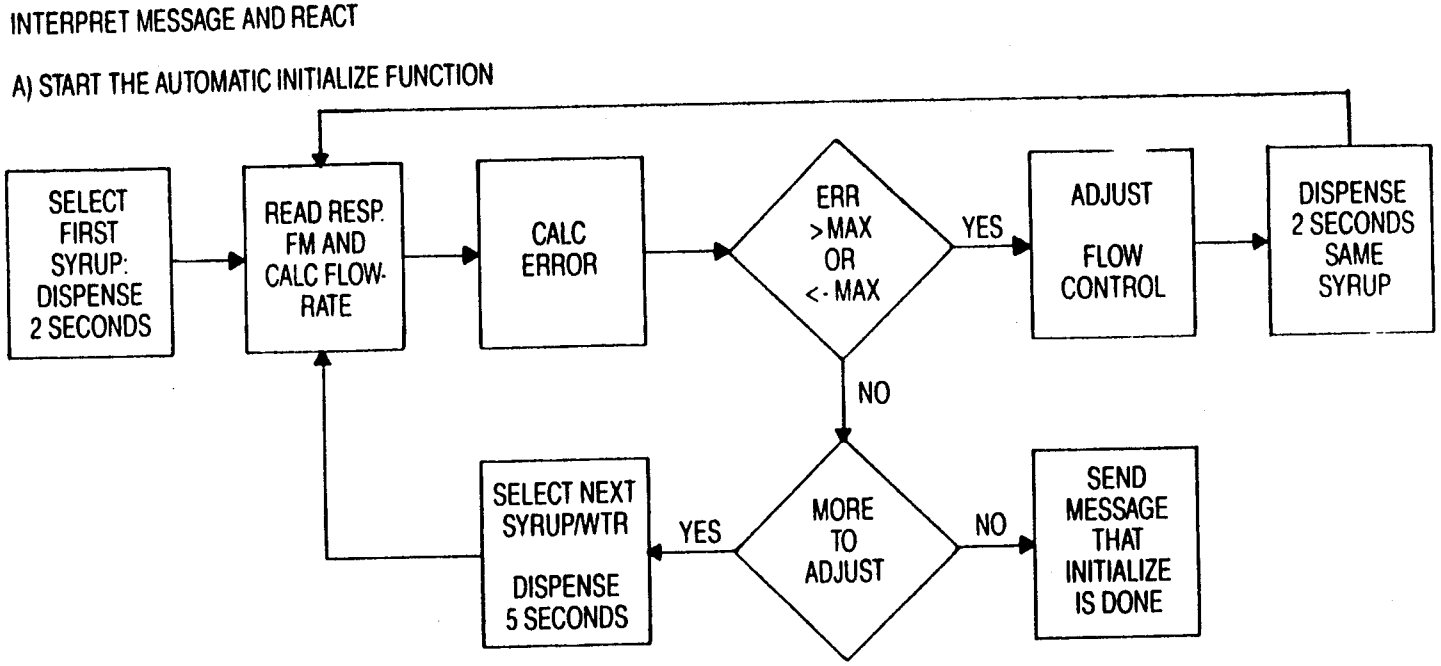
Figure 14:
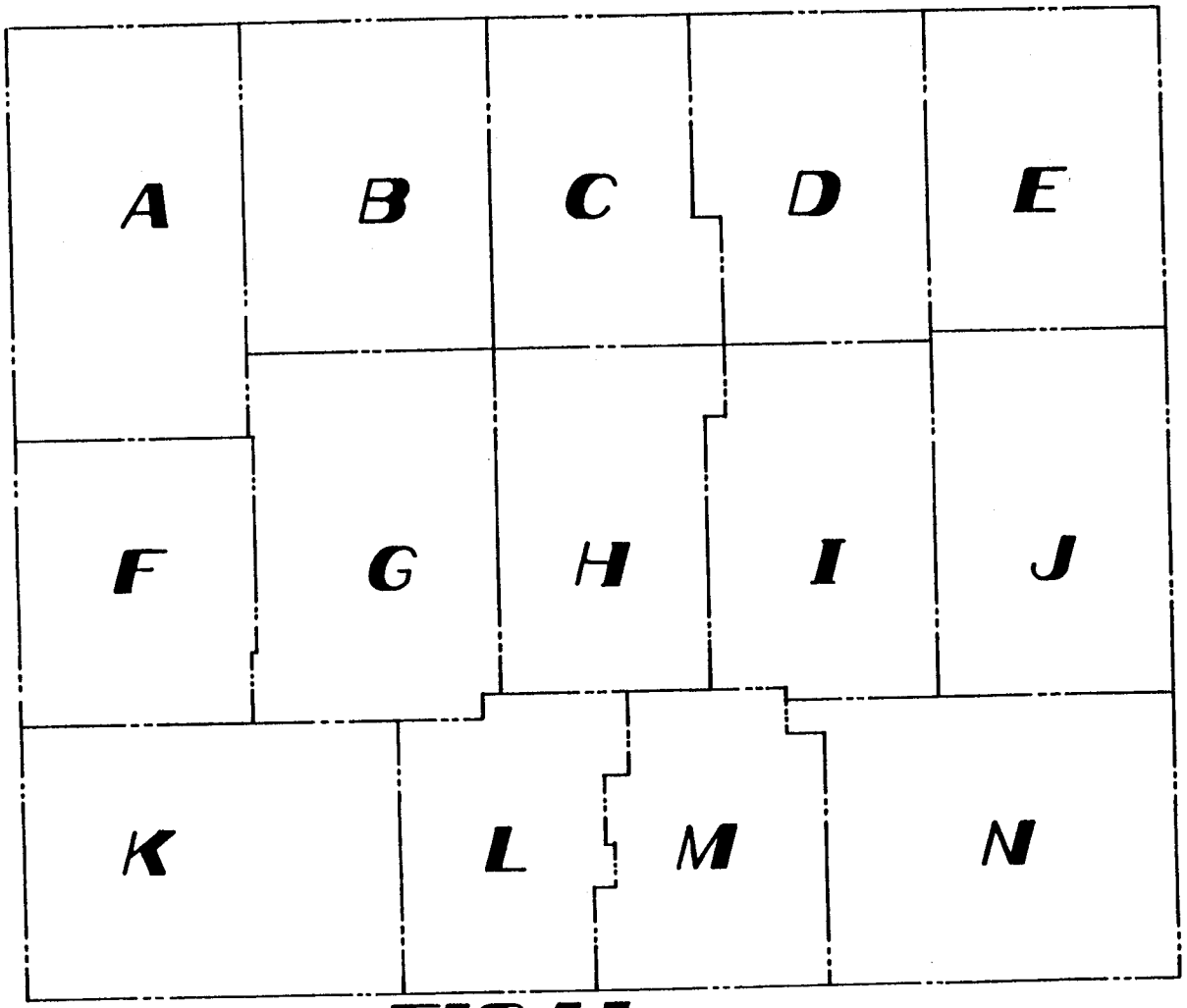
FIG. 14 is a top view of the mechanism of FIG. 13.

Referring mainly to FIG. 10, the VQM then sets a byte to request an initialization of the beverage dispenser system. The initialization process consists of dispensing a series of 2 second draws for every syrup, each draw followed by an adjustment to the flow control if necessary (an adjustment is made if the flow rate error is outside, for example, (±4% error). This is done automatically by the VQM software with no interaction from the store personnel. When all of the circuits have been adjusted to within the specified error, the store personnel is notified and the VQM enters its normal operation mode.

Figure 8:
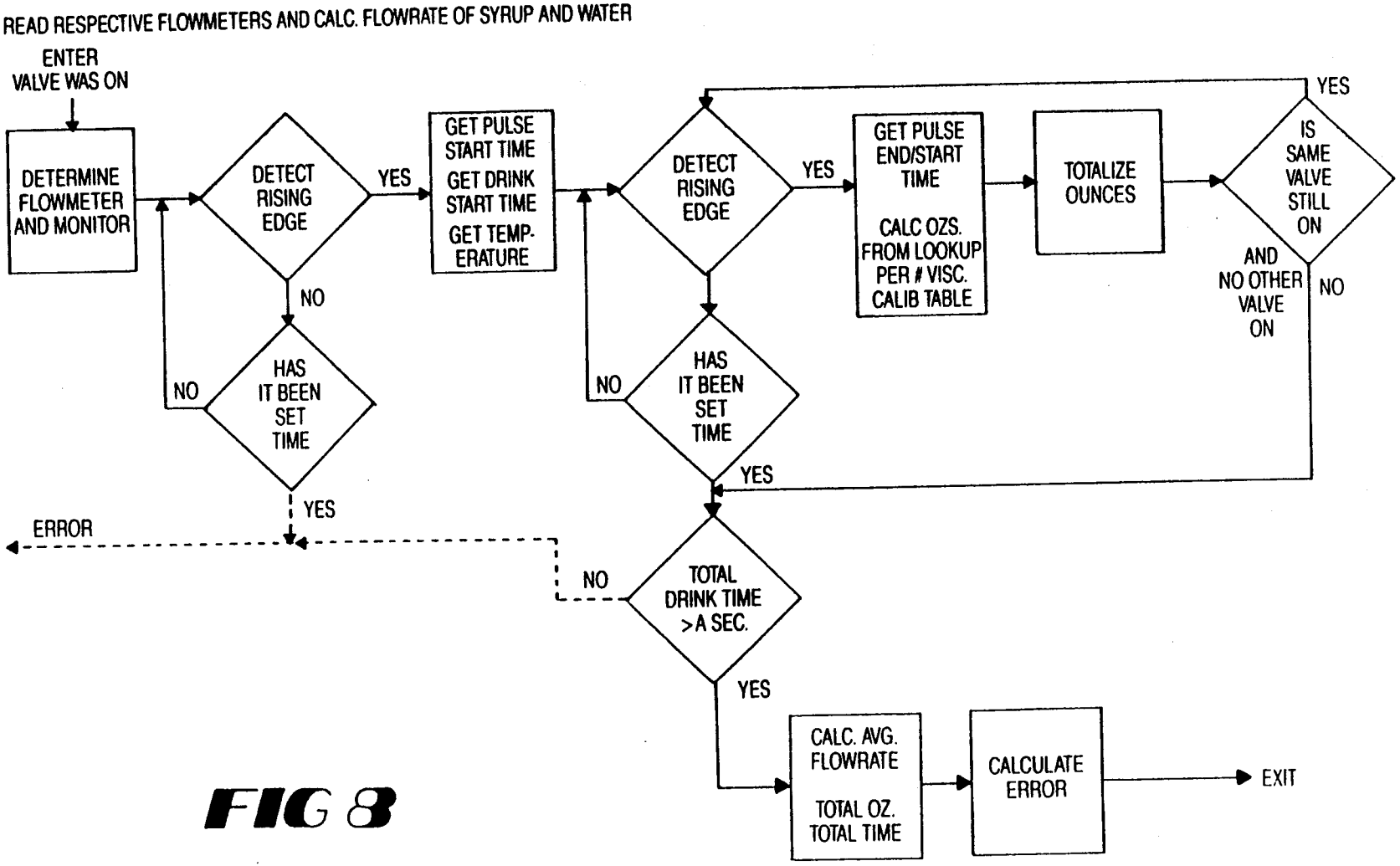

Referring now primarily to FIG. 8, the VQM then remains idle until signaled by the dispenser control board that a beverage is being dispensed. The information passed to the VQM includes the syrup line and water or soda line currently in use. The VQM then goes to the respective flowmeters and monitors pulses. This data, the period between pulses paired with syrup viscosity data is then interpreted into ounces of fluid dispensed. A timer is running throughout the data collection period, so that at the end of the dispense the total ounces is divided by the total ounces to calculate the fluid flow rate. This is done for the syrup and the water individually.

Figure 7A:
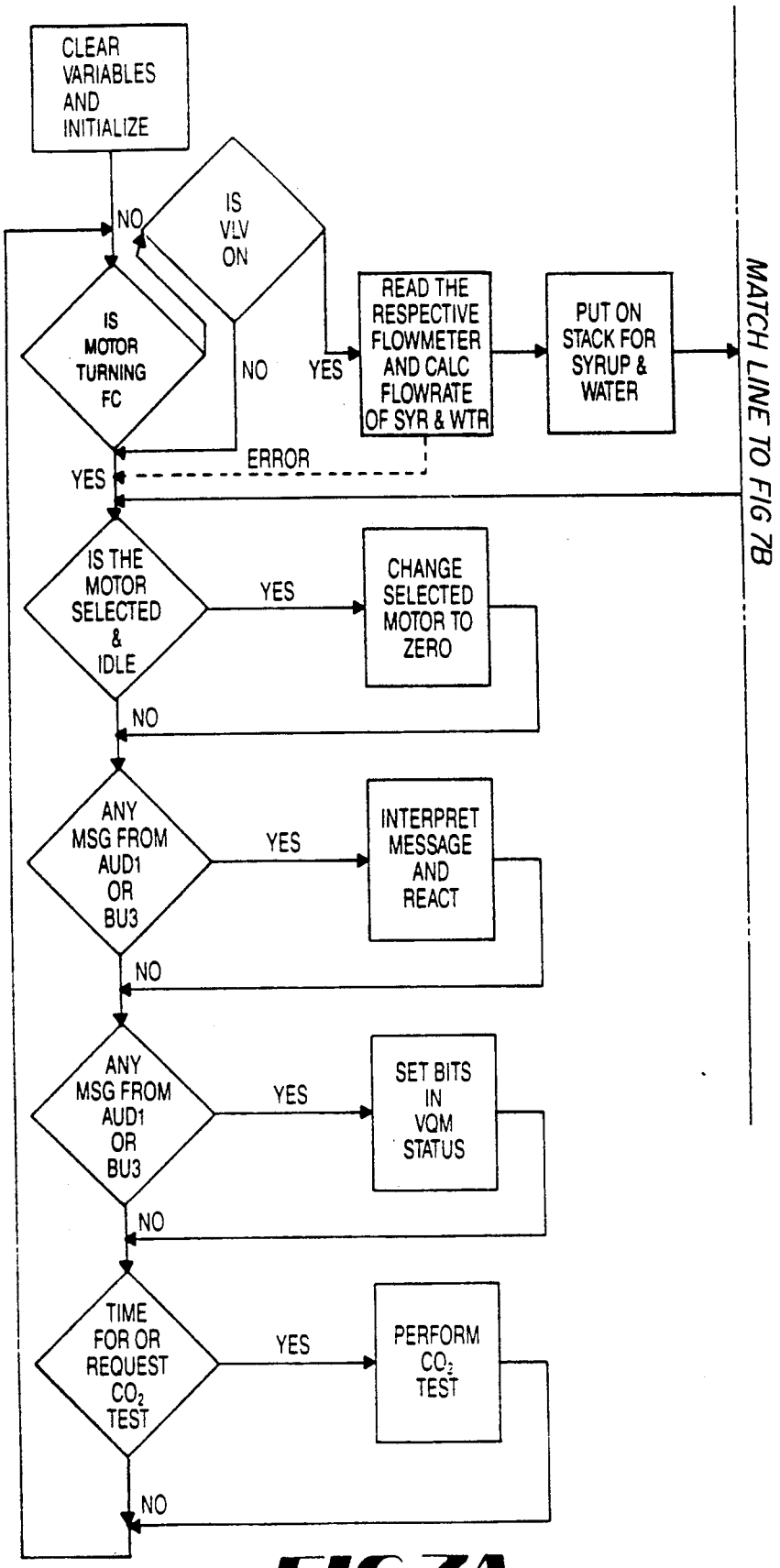
FIGS. 7A, 7B, and 8–10 are flow diagrams of the software.
Figure 7B:
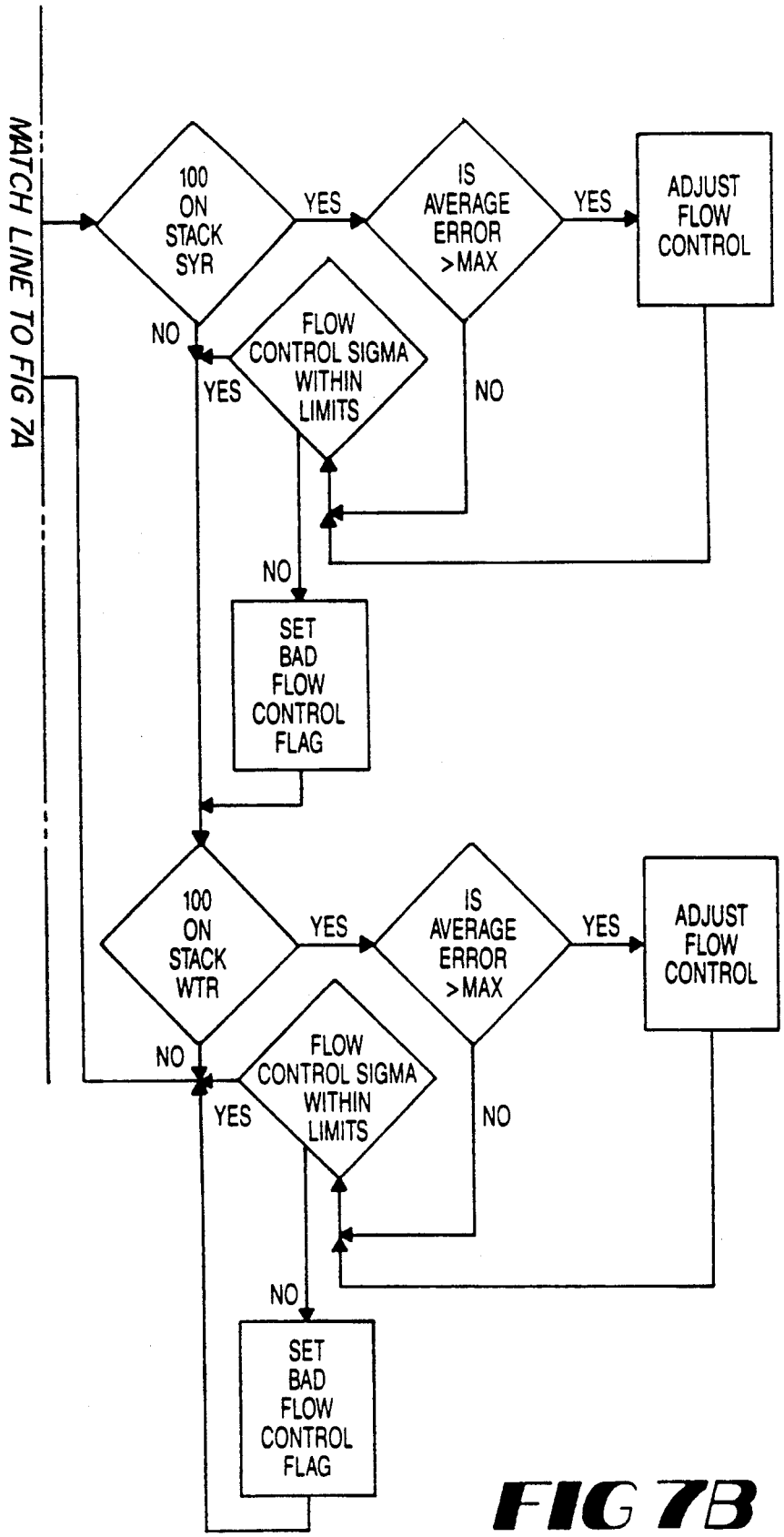

Referring now primarily to FIG. 7, this flow rate is compared to the desired flow rate and a flow rate error is then stored into a queue. There is a specific queue for each flow control that is to be adjusted. Therefore, whenever a carbonated Beverage 1 is dispensed, a value is stored into the carbonated water queue and a value is stored in that respective syrup (Beverage 1) queue. When a queue has reached a length of 100, the average error of the flowrate is calculated. If this error is above ±1% then a calculation is done to see what the adjustment to the flow control should be. Otherwise, the 101st dispense of this fluid is entered into the queue, the very first dispense is deleted and the average error of the last 100 drinks is calculated. This continues until an error of greater than ±1% is calculated on the last 100 drinks dispensed through any of the beverage lines.

$$\text{Steps} = \frac{(\text{Actual Flow Rate} - \text{Target Flow Rate})}{(\text{Flow Rate/Revolution})} \times \frac{\text{Steps}}{\text{Revolution}}$$

Figure 9:
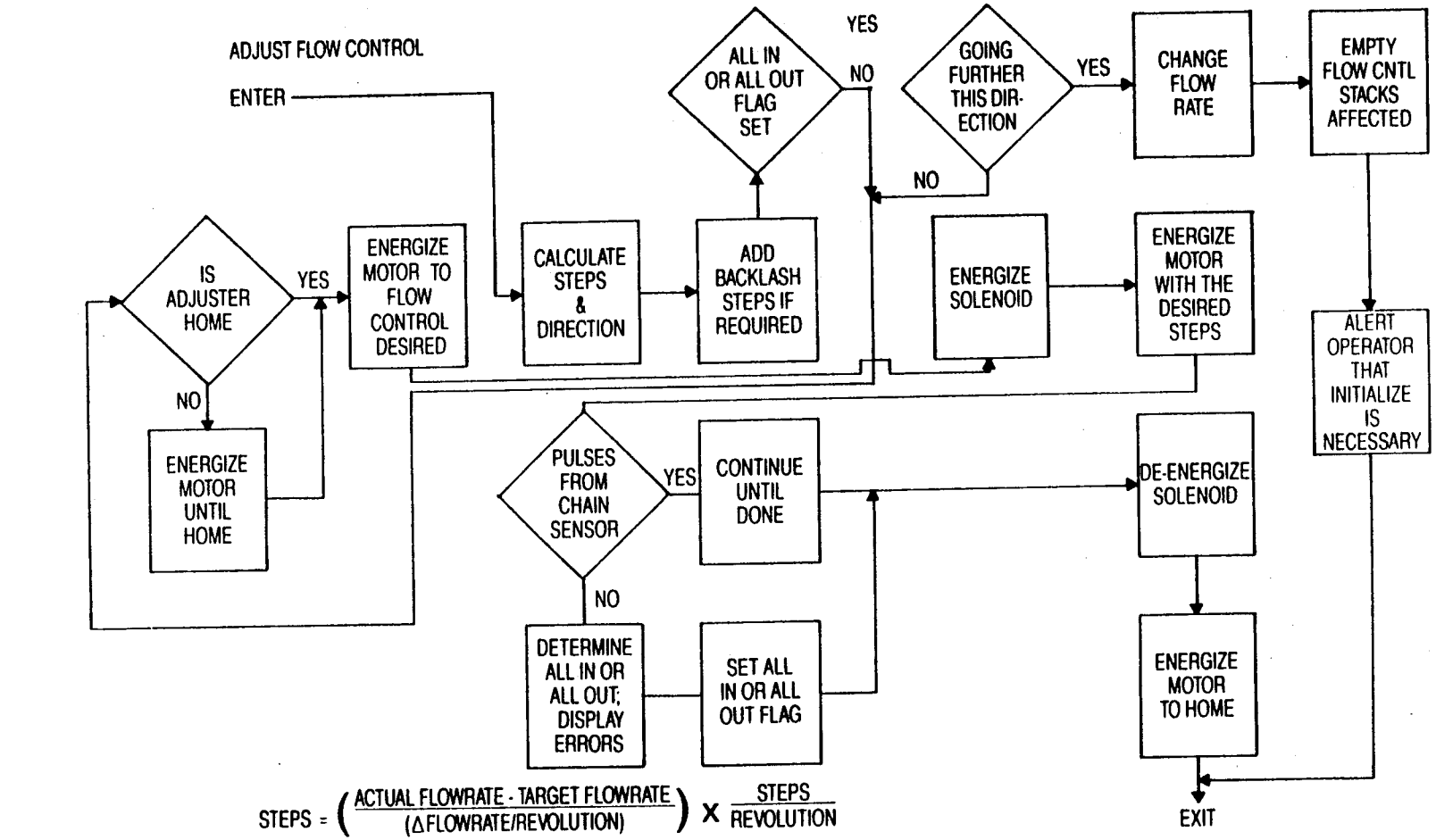

Direction = Clockwise or Positive for Negative Error
= Counter − *CW* or Negative for Positive Error Referring now primarily to FIG. 9, when this error is encountered, a calculation is performed that uses the information gathered over the last 100 drinks. The amount of adjustment is determined by using a constant value for sensitivity for the flow control (ounces/sec per full 360 degree turn of the flow control), the stepper motor steps required for one full rotation of the flow control and the desired flow rate and the error. Knowing these four values leads to the number of steps needed to be sent to the stepper motor using the following equation.

The VQM then sends motor steps in order to move the carriage to the appropriate flow control, it's position determined by the position sensor getting pulses every time it passes a flow control position. For example, if the carriage was to go to flow control 5, it would continue to send steps to the motor until it receives 5 pulses from the position sensor. Then the motor pulses stop and the solenoid on the carriage is de-energized. The VQM then sends the specified number of step pulses in the specified direction (a positive number from the equation identifies a clockwise turn, a negative number a counter-clockwise turn) to the stepper motor. When the adjustment is finished the adjuster returns to the home position until another flow control has an adjustment required. The queue used to determine the flow control error trend is then emptied and another adjustment cannot occur on this particular flow control until at least 100 drinks of that flavor have been dispensed, in the presently preferred embodiment. Clearly other numbers can be used.

In the flow control has bottomed out in either direction and an adjustment is attempted to go further in that particular direction, a sensor has been added to alert an error condition. This sensor consists of the photoelectric eye 62 that is placed on either side of a slotted wheel 61 that is attached to one of the chain sprockets. The pulses from the sensor must keep coming to the processor at a steady rate or else it is determined that the chain is not moving, therefore the sprocket attached to the flow control is not moving, and the flow control must be bottomed out. This error is relayed to the store personnel as a possible hydraulic limit (in that the adjustment was to increase flow and the system pressures were not high enough to permit such a flow rate) or another error.

Referring now primarily to FIG. 7, the VQM system is also monitoring the standard deviation of each flow control's queue of errors. It is known that the flow control has a deviation of about 3%. If the deviation is more than 5%, a warning is given to store personnel that the flow control in that certain circuit is possibly bad and needs to be replaced.

Communication between the VQM and a beverage dispensing system can be done via an RS422 full duplex line. The host or master for the communication is the beverage dispensing system, the slave being the VQM. The messages sent include the settings data at power up or as requested by a bit set in the VQM status. This status is requested by the host system and is communicated at least every second. Error and warning messages may be sent to the dispensing system through this communication line.

Figure 11A:
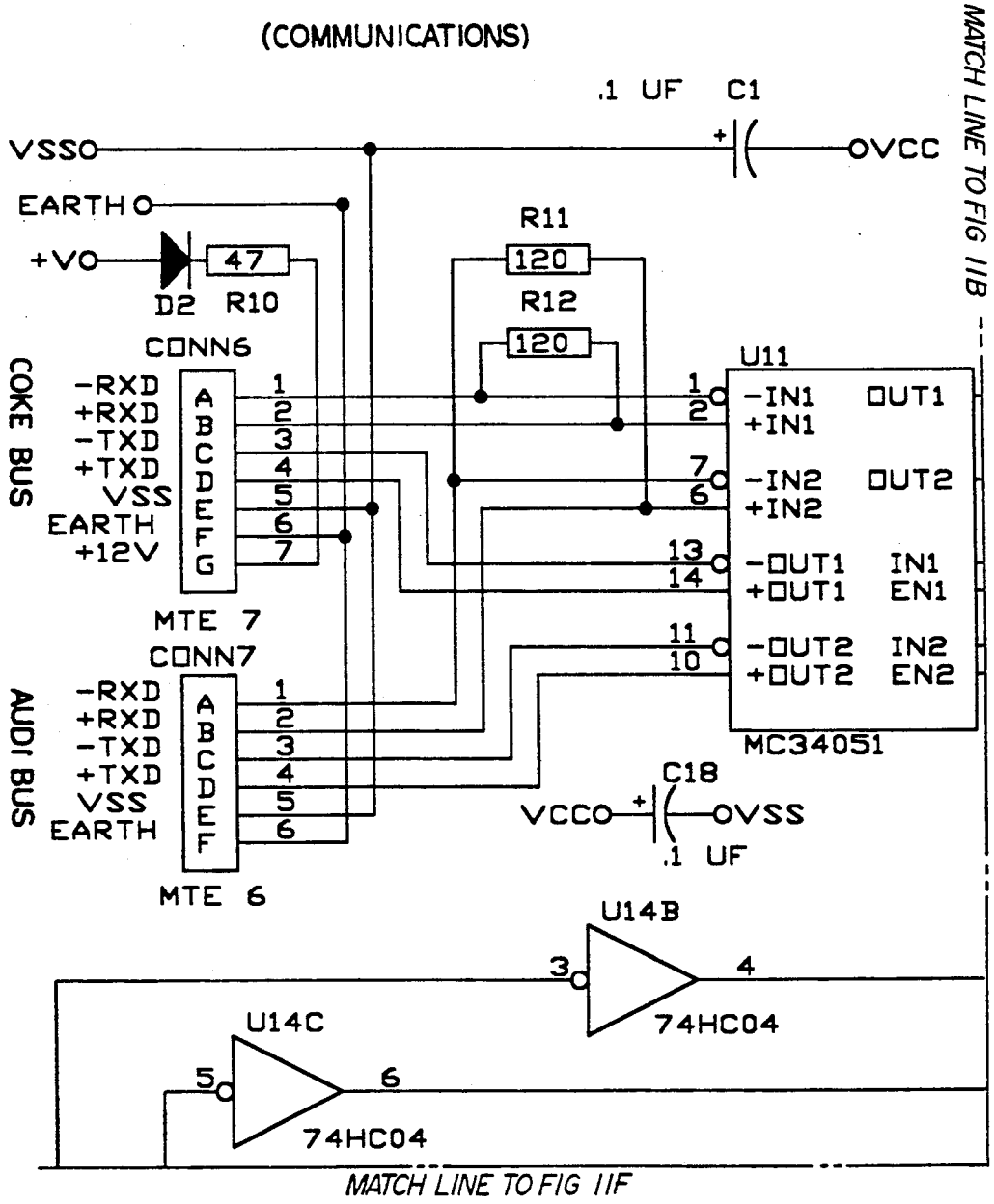
FIGS. 11A–11N and 12A–12E are electrical schematics of the electronic control system.
Figure 11B:
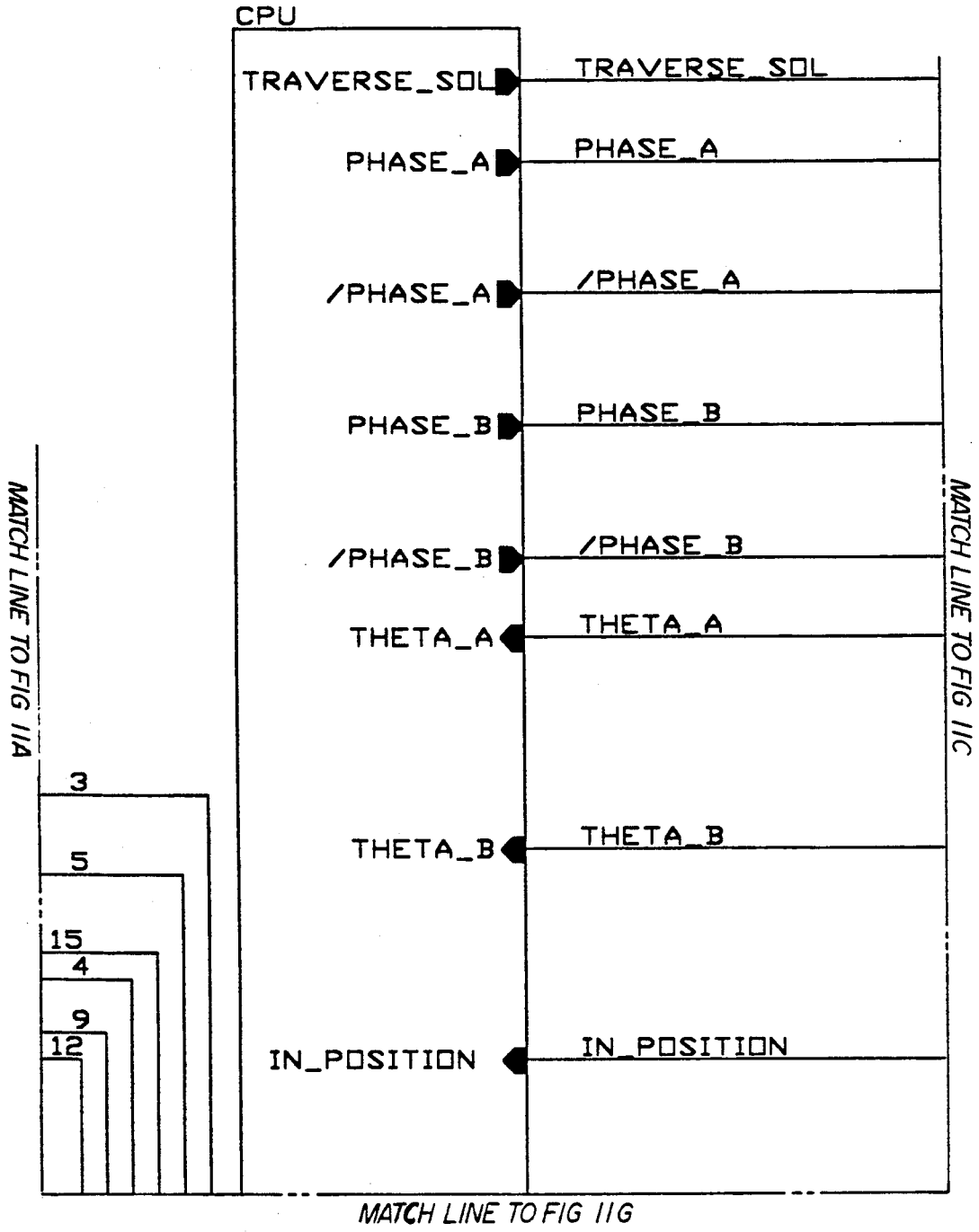
Figure 11C:
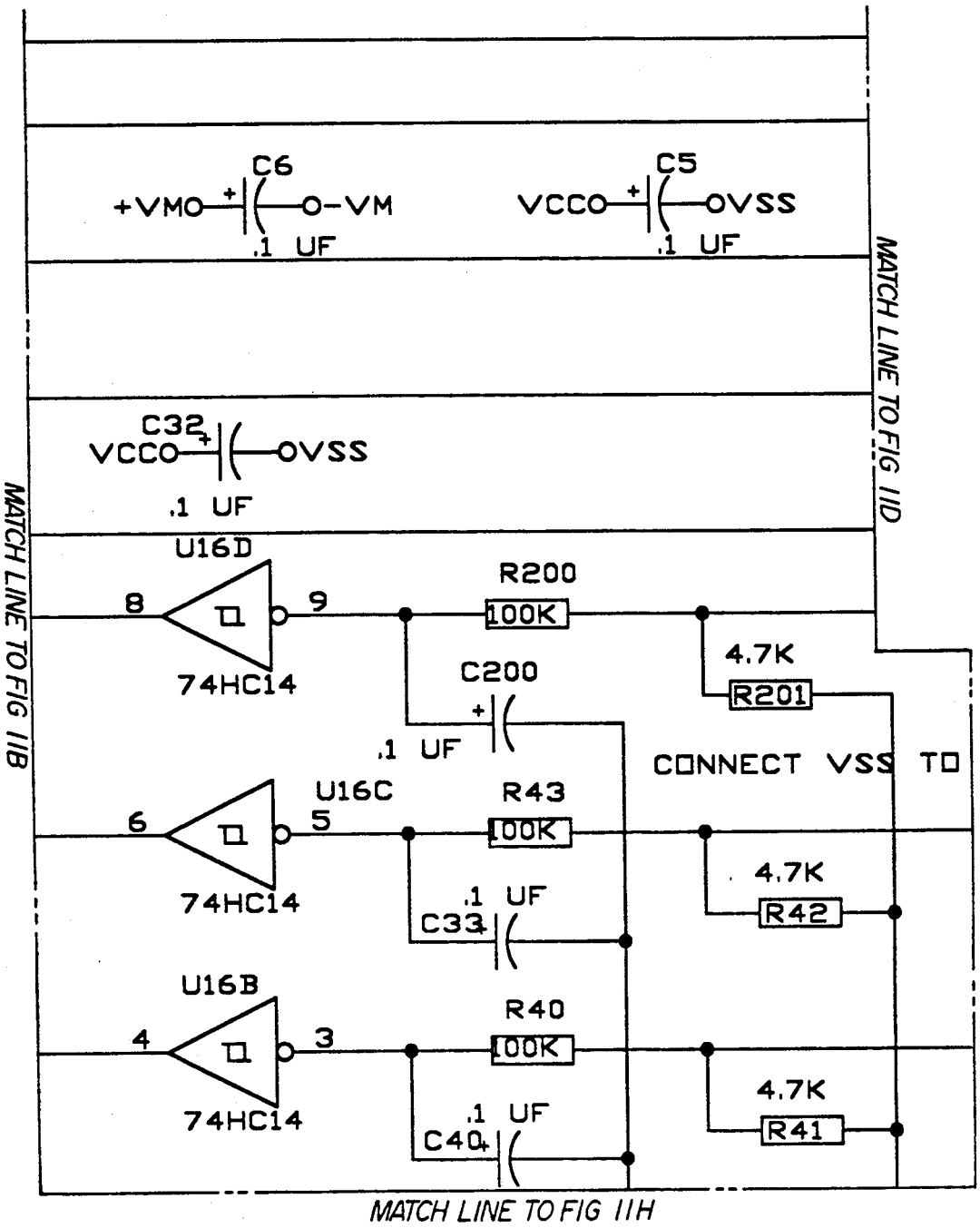
Figure 11D:
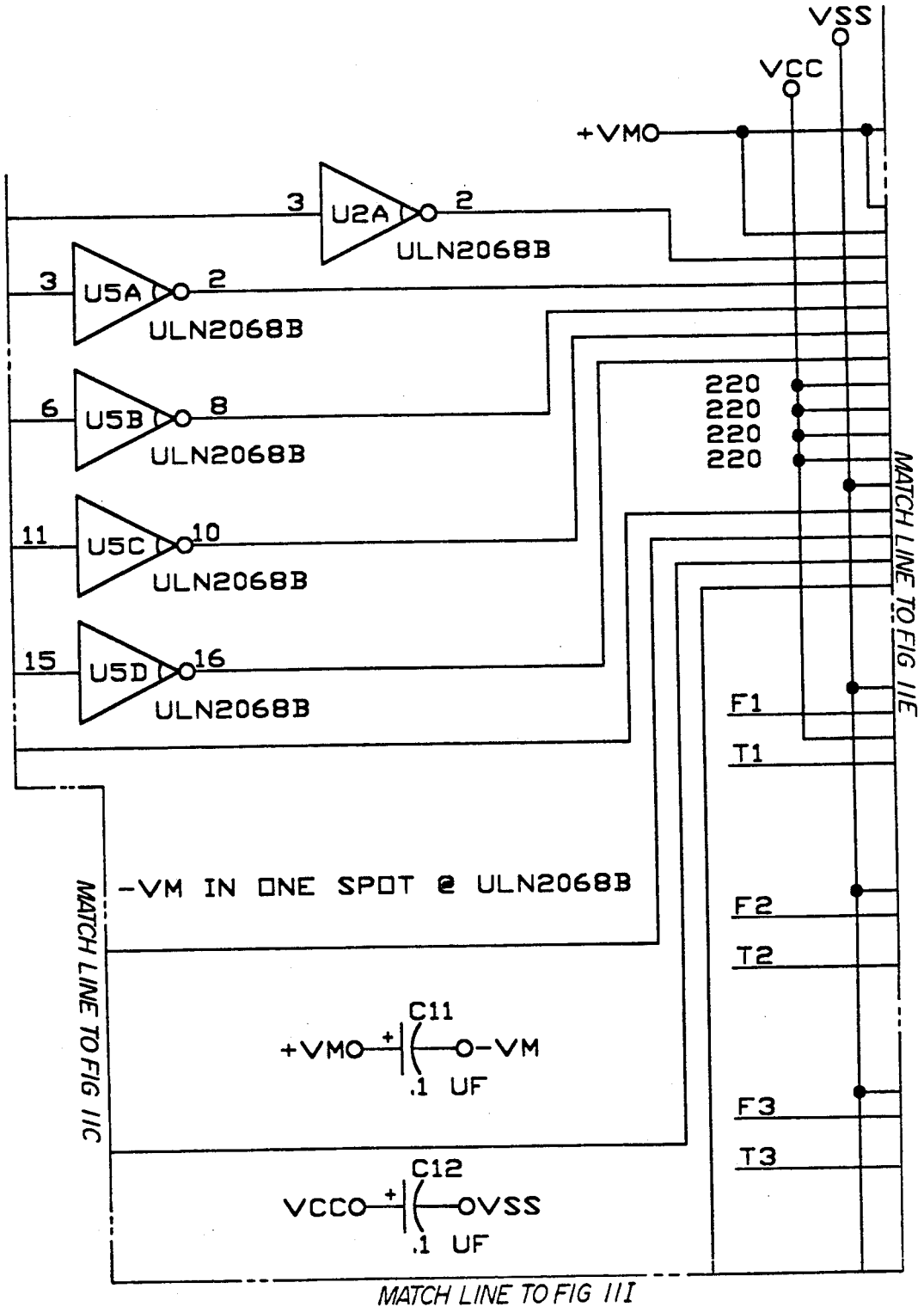
Figure 11E:
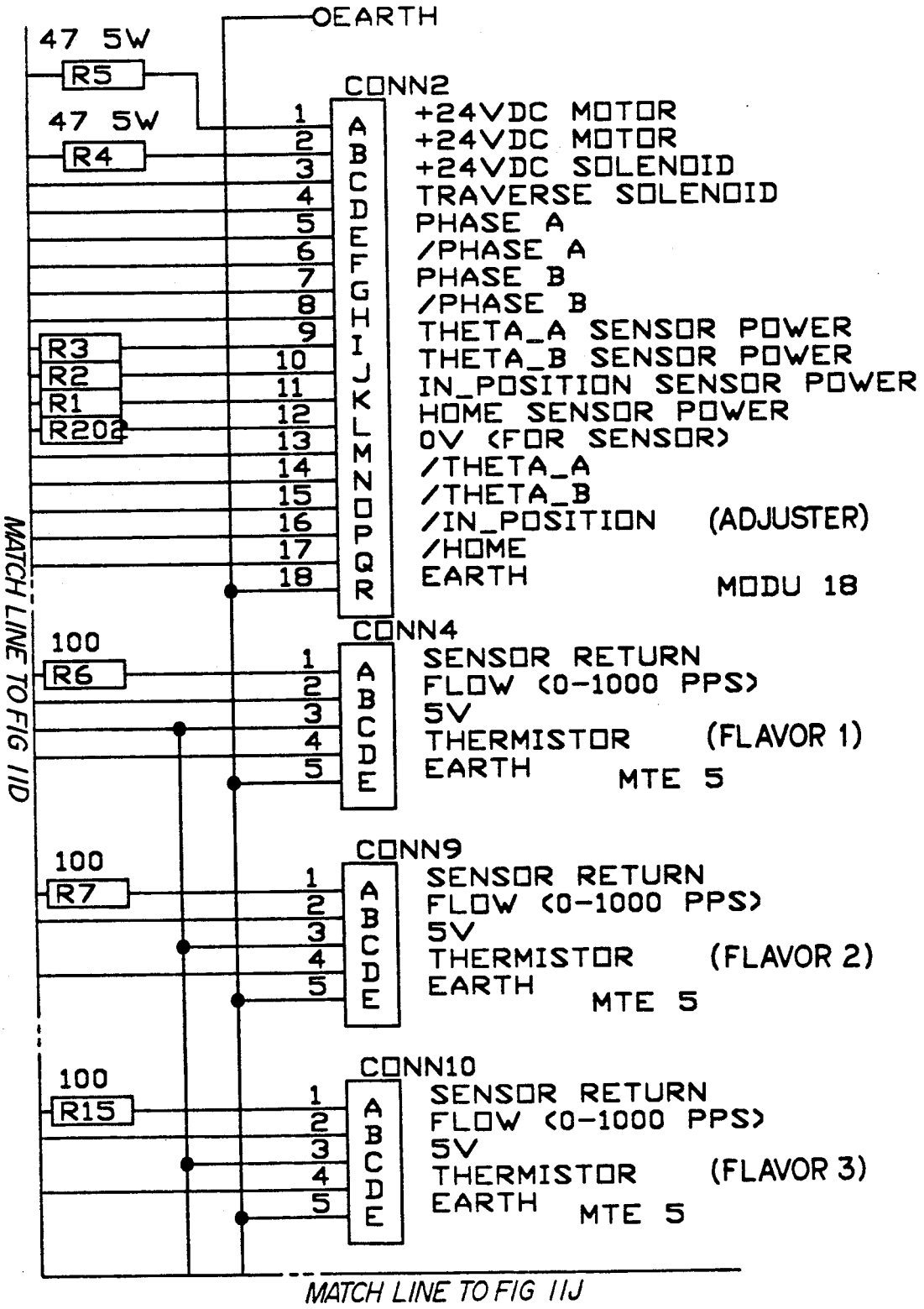
Figure 11F:
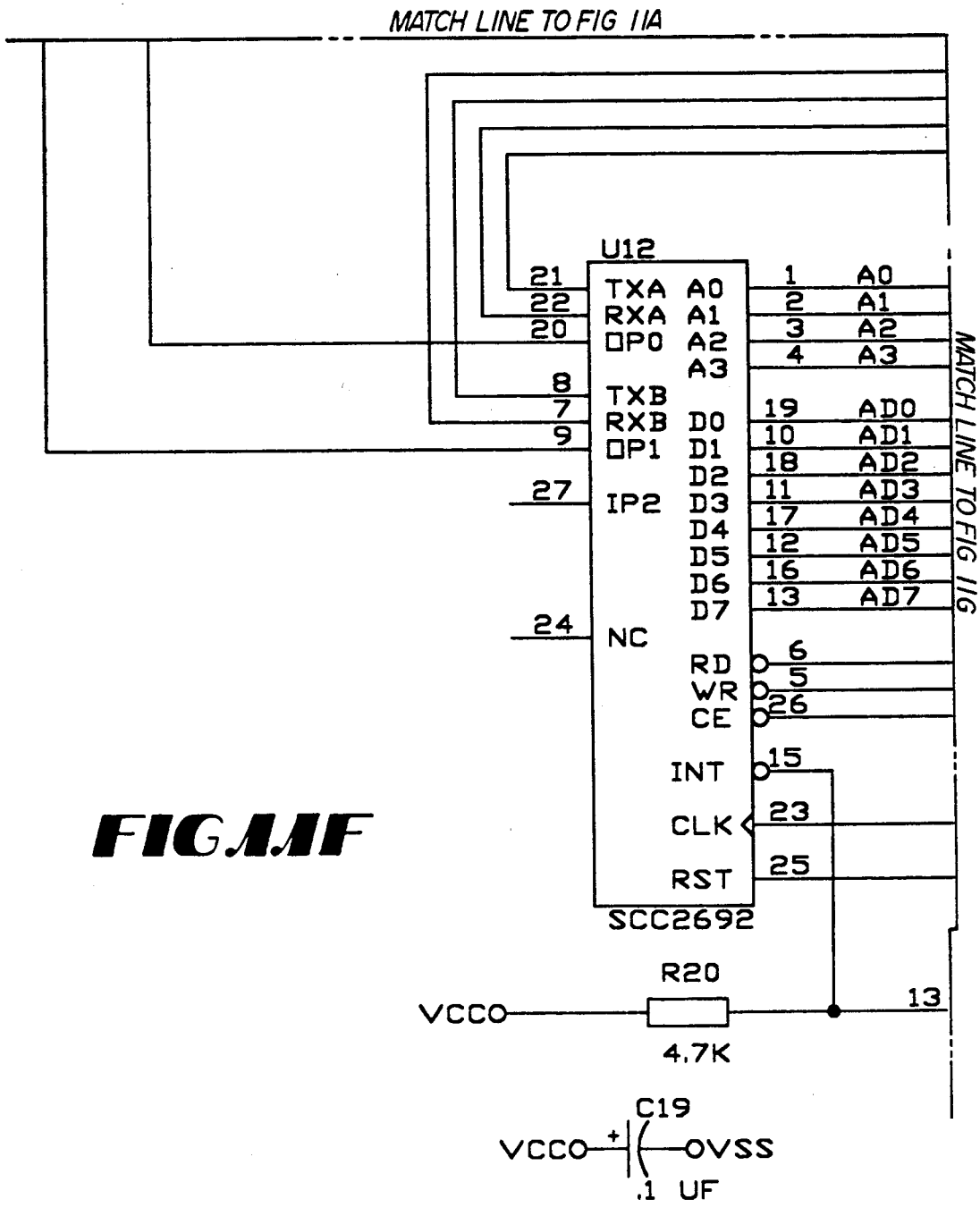
Figure 11G:
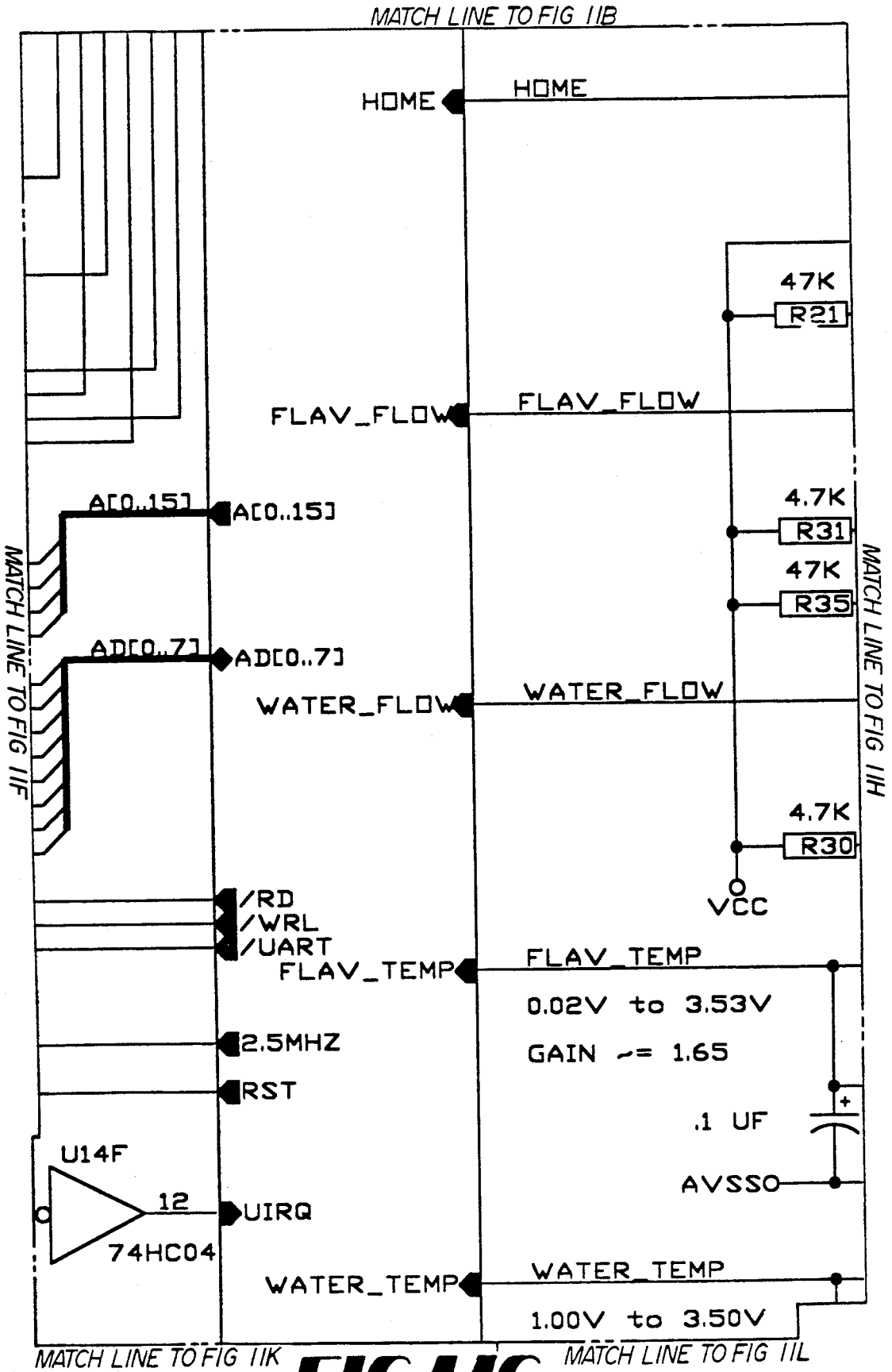
Figure 11H:
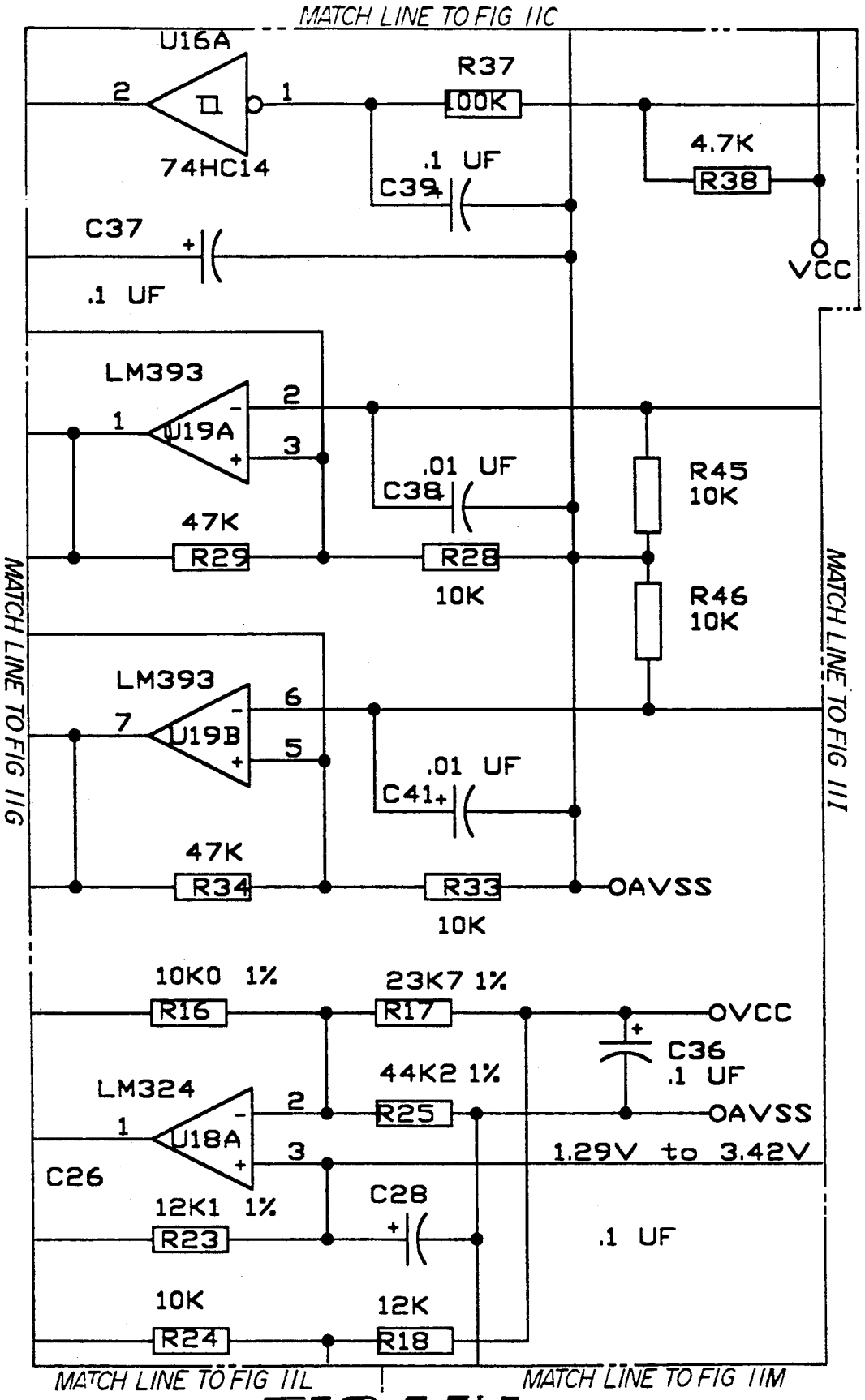
Figure 11:
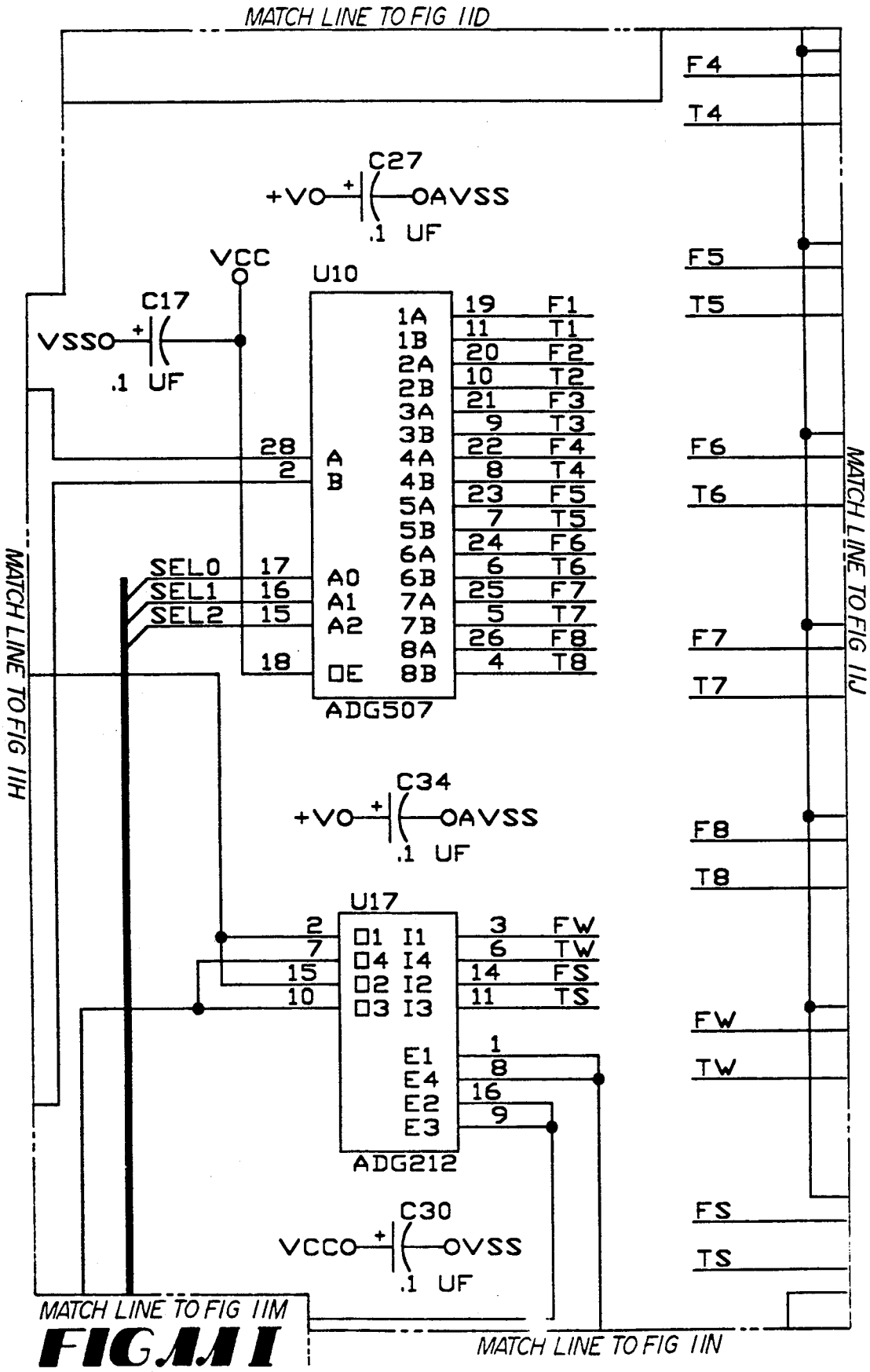
Figure 11J:
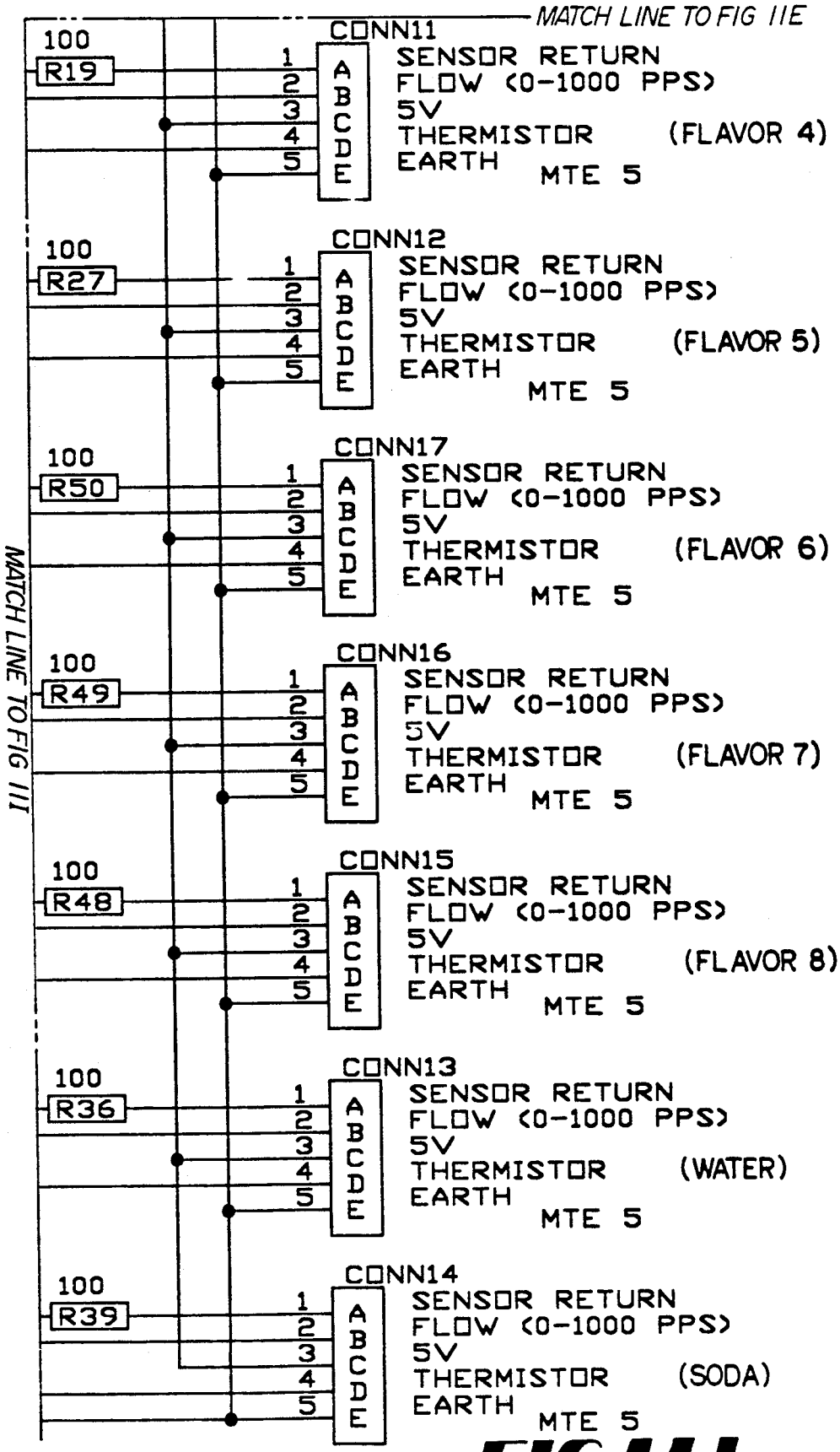
Figure 11K:
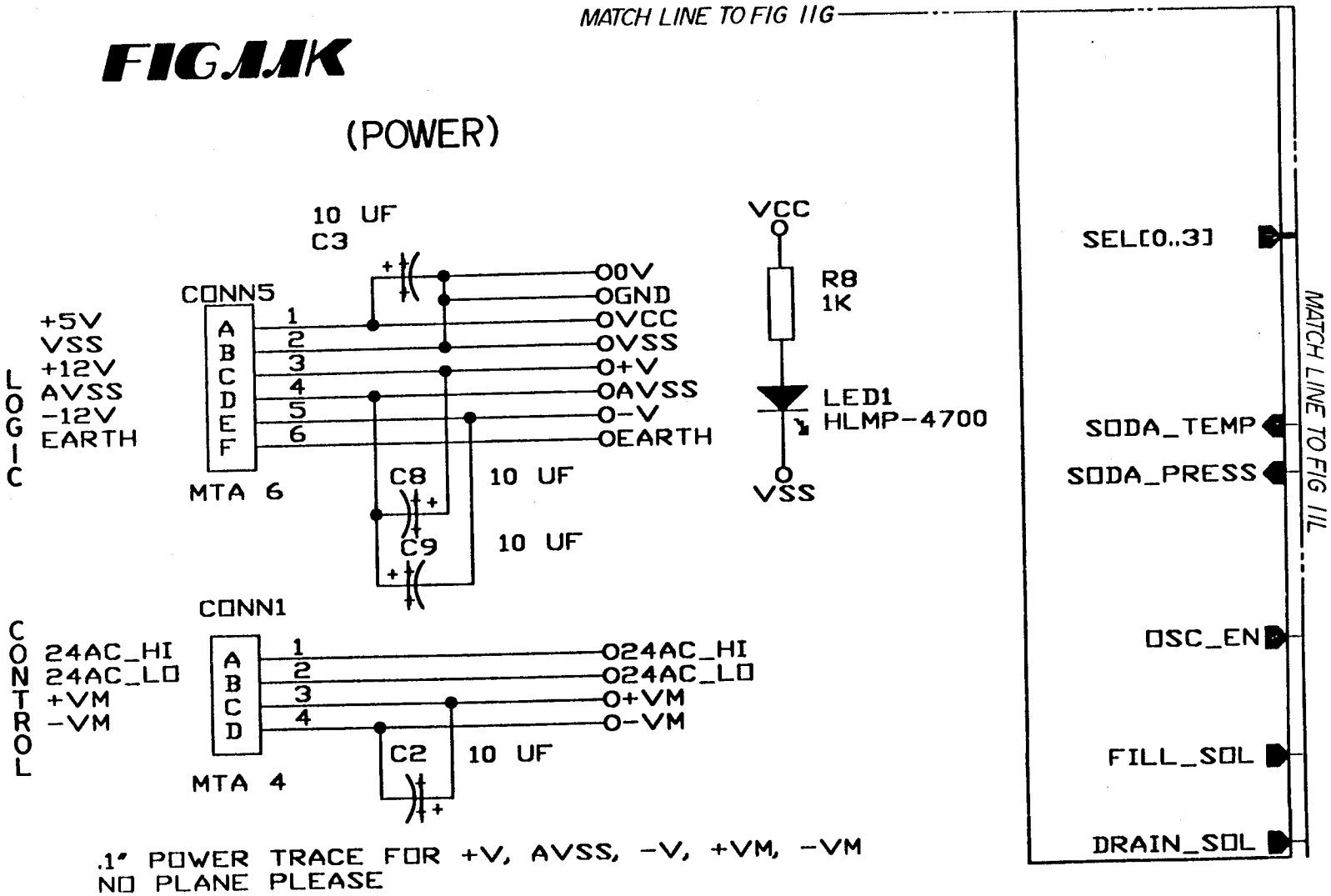
Figure 11L:
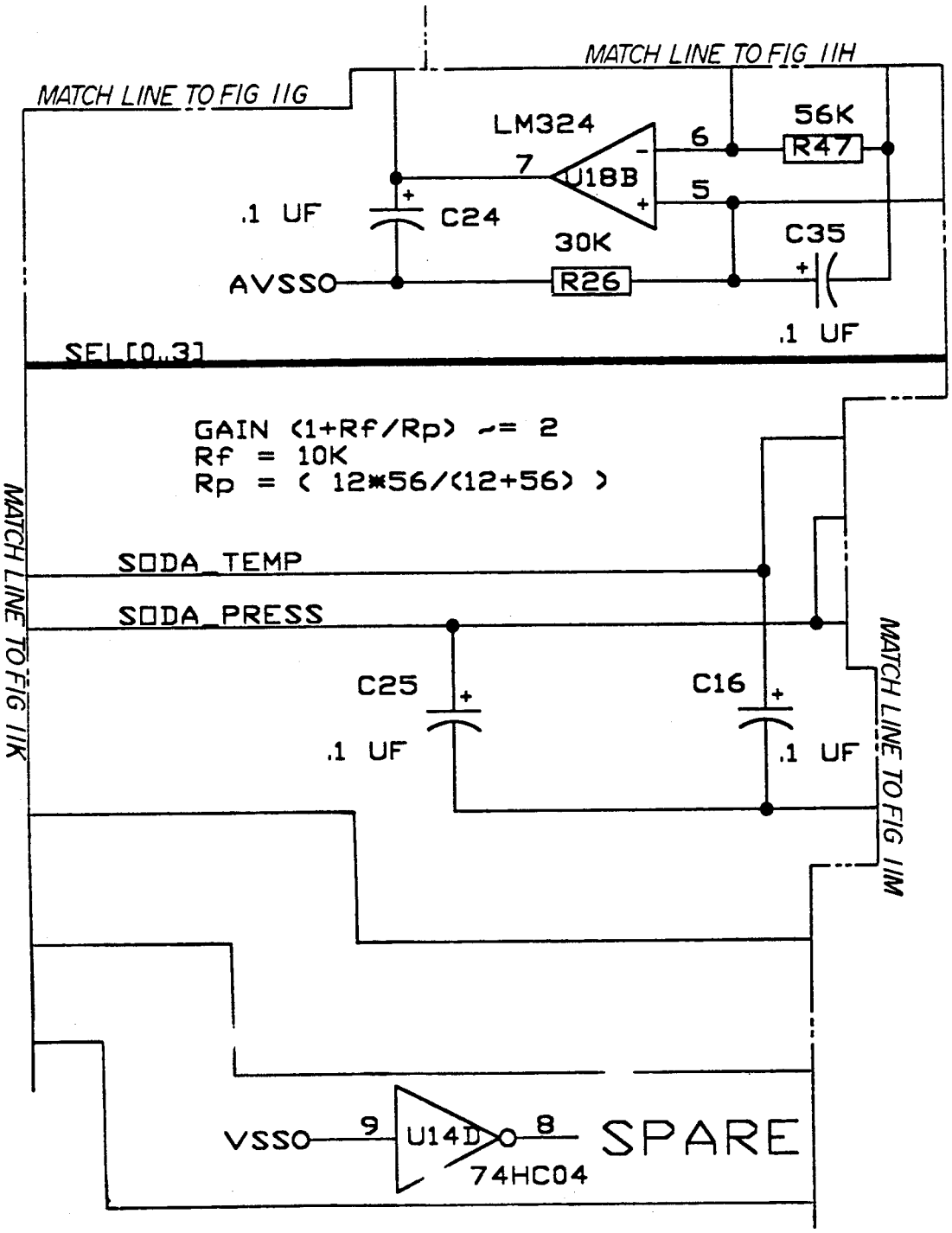
Figure 11M:
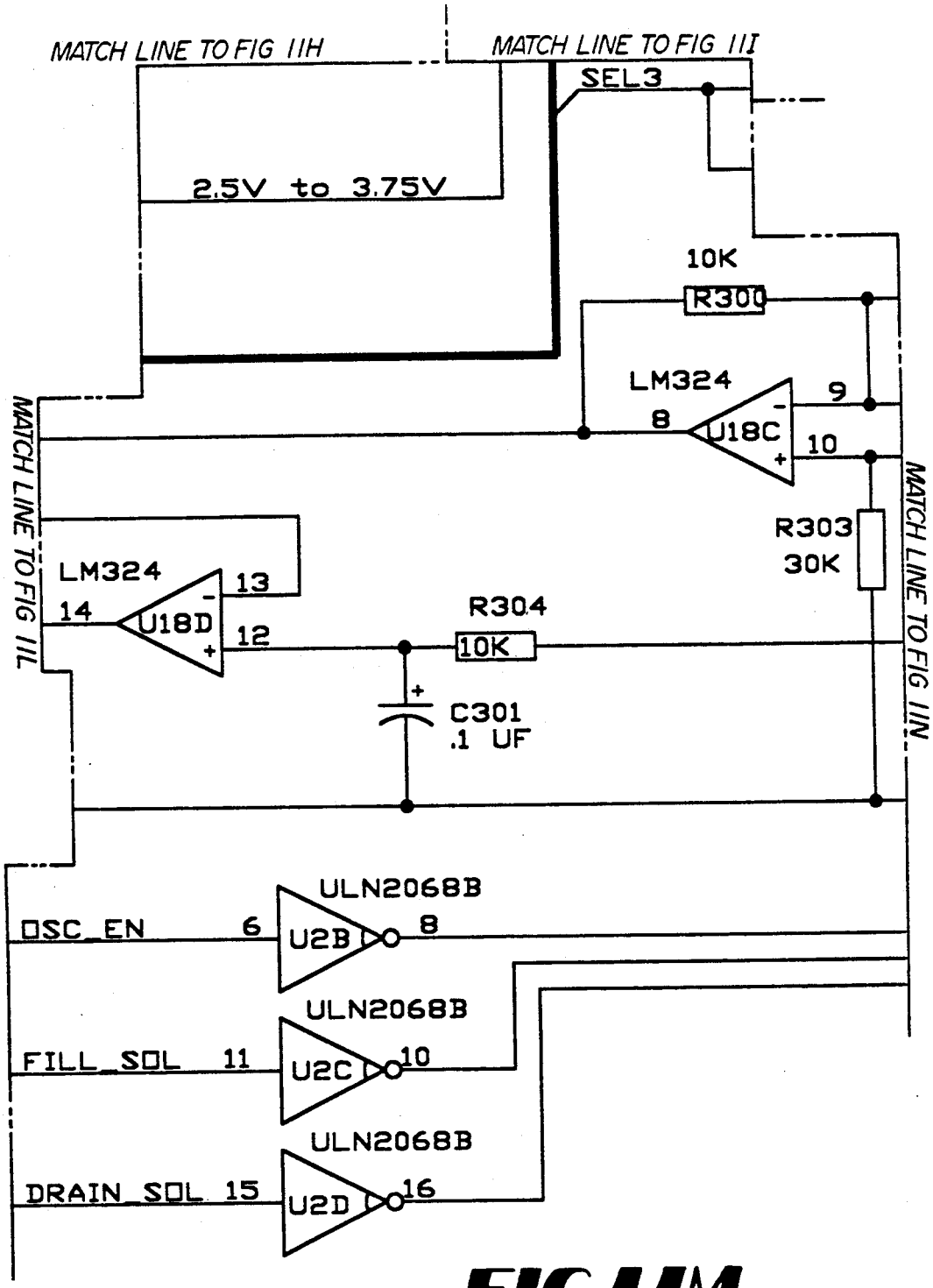
Figure 11N:
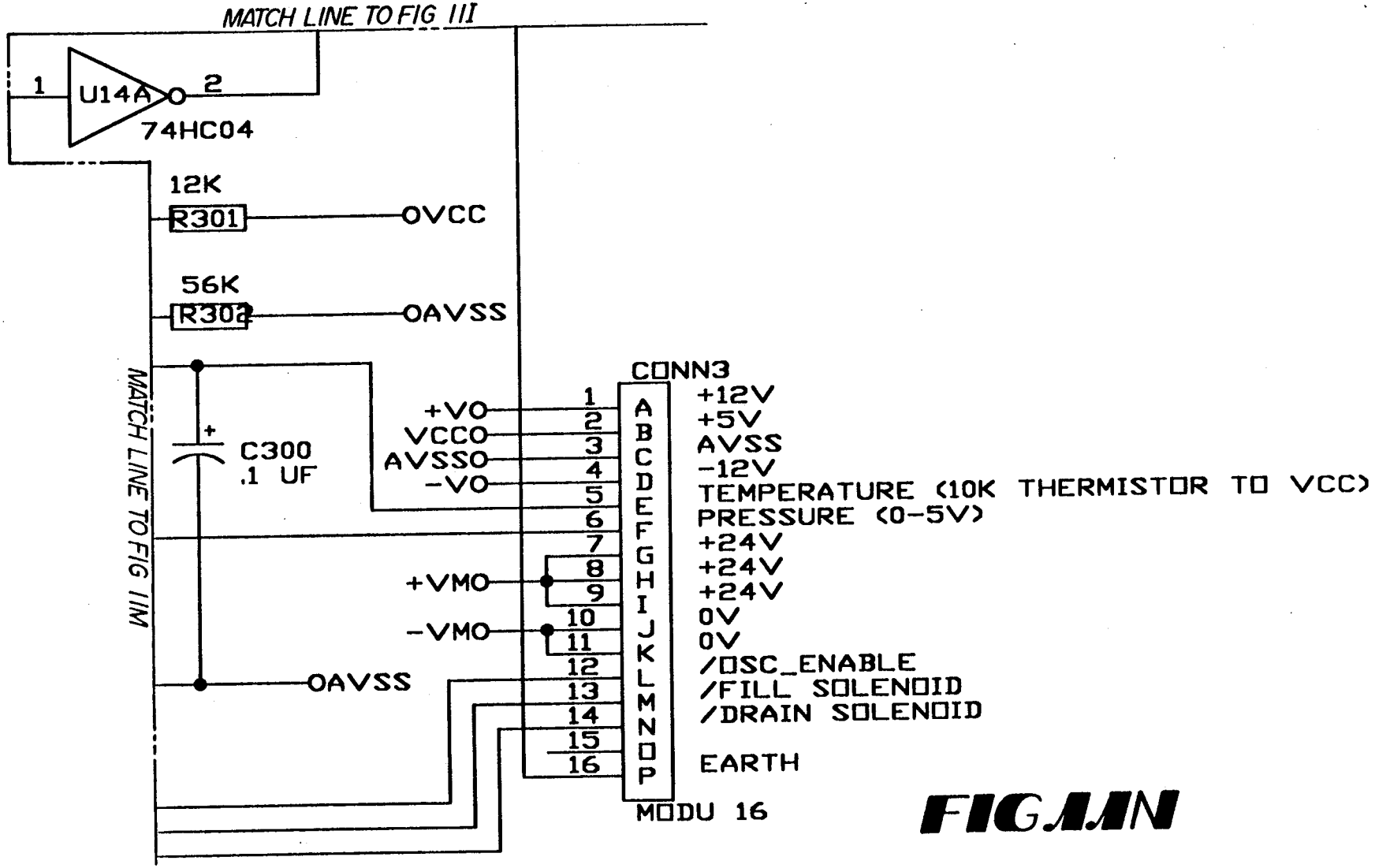
Figure 12:
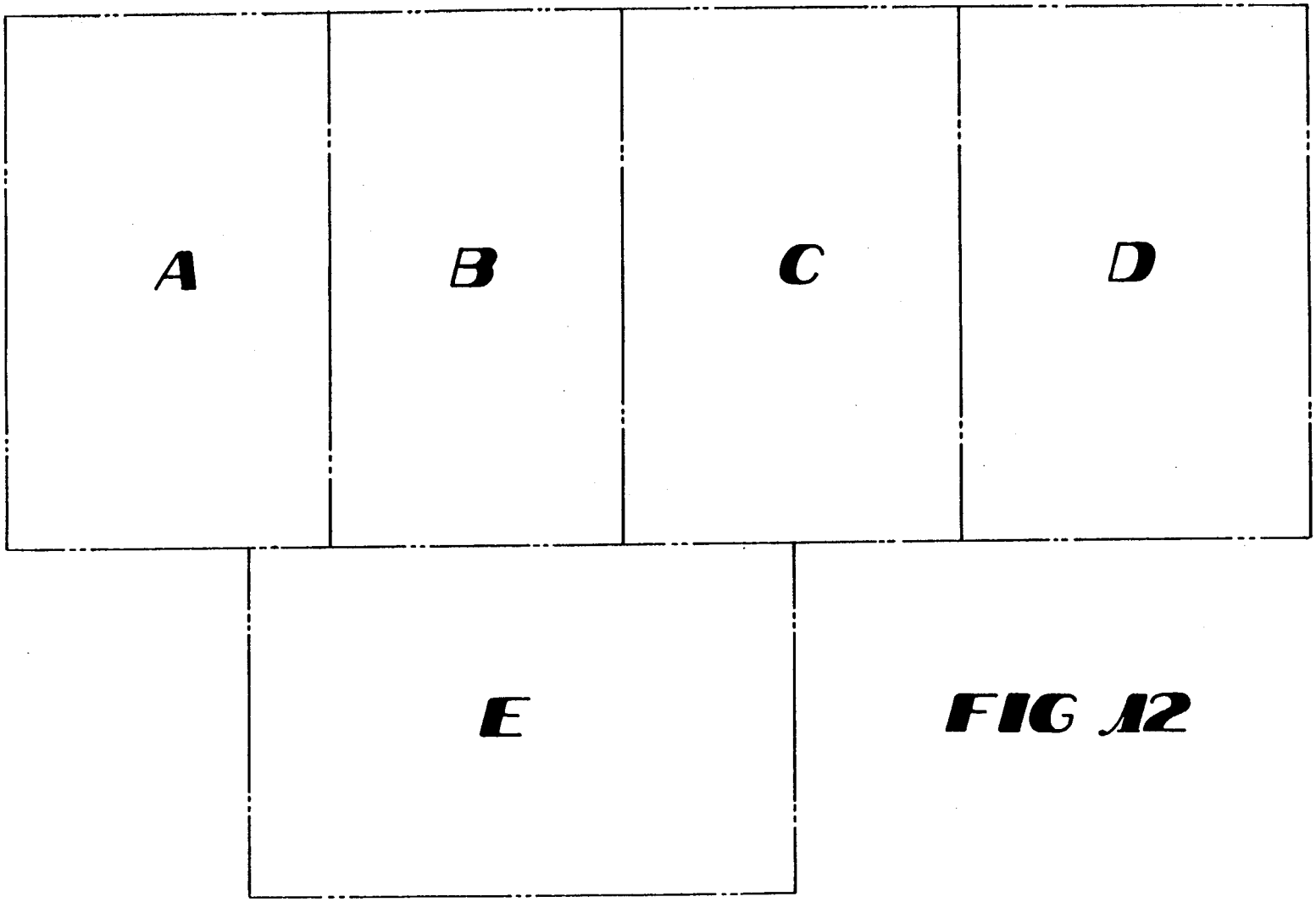
Figure 12A:
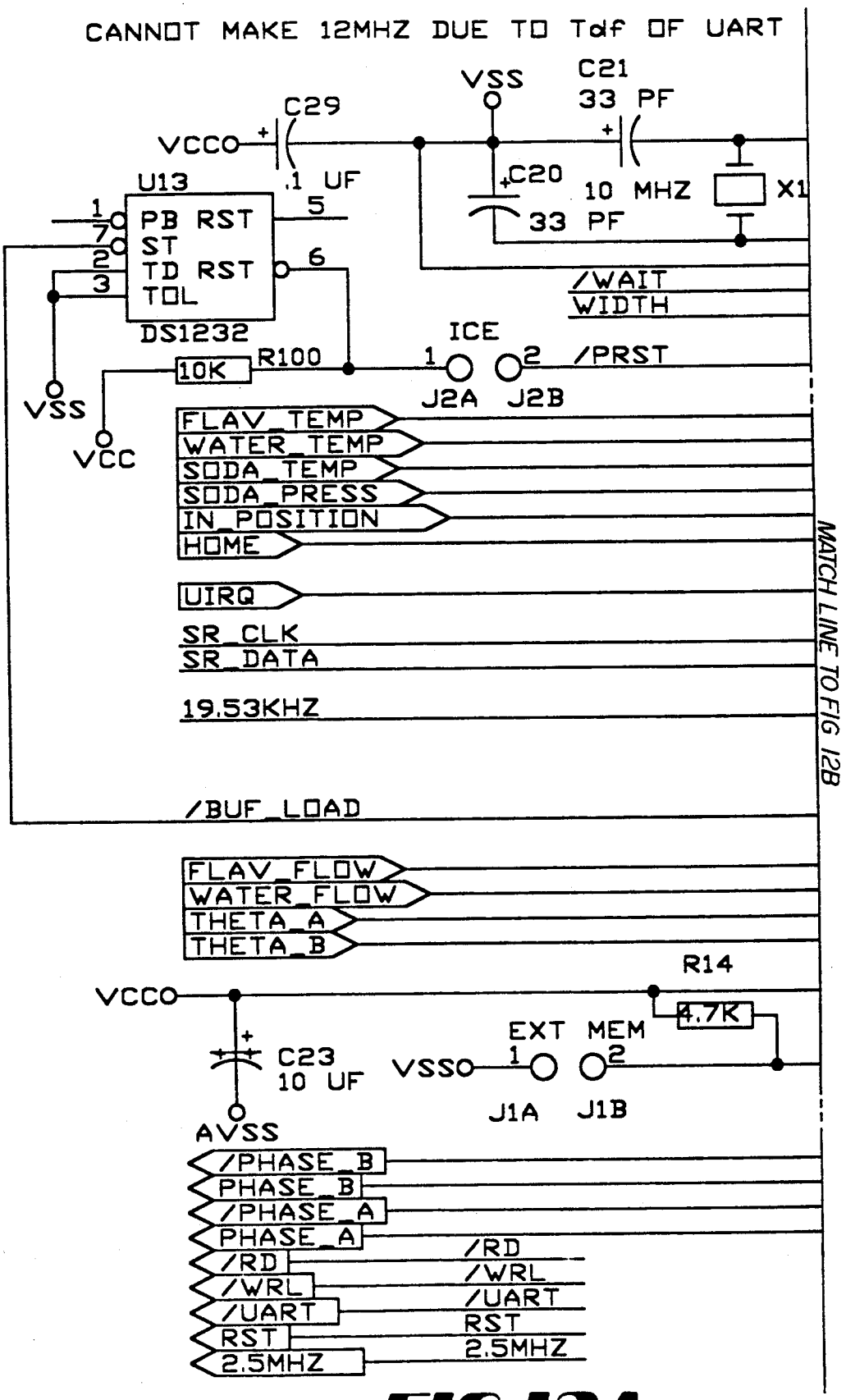
Figure 12B:
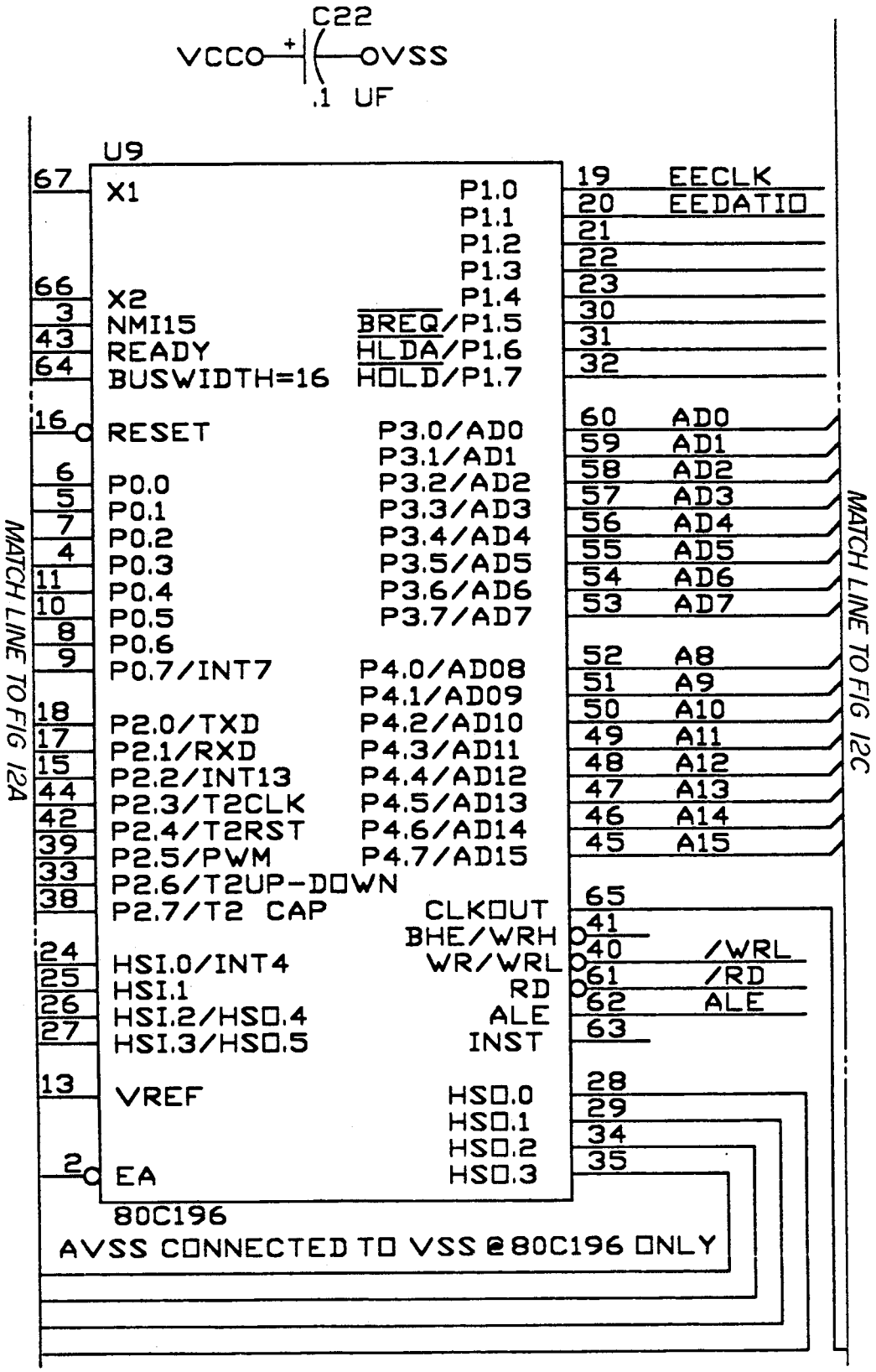
Figure 12C:
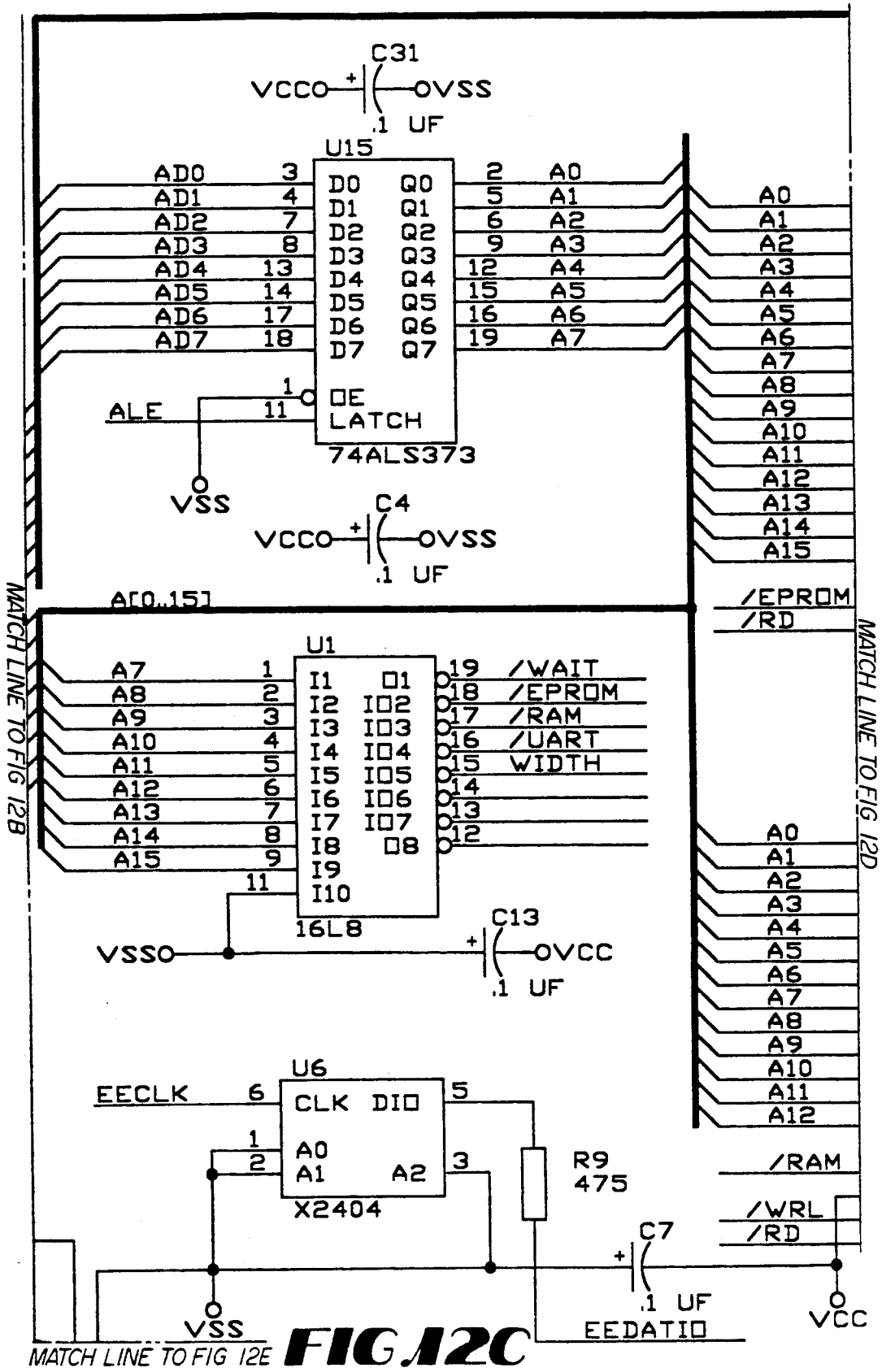
Figure 12D:
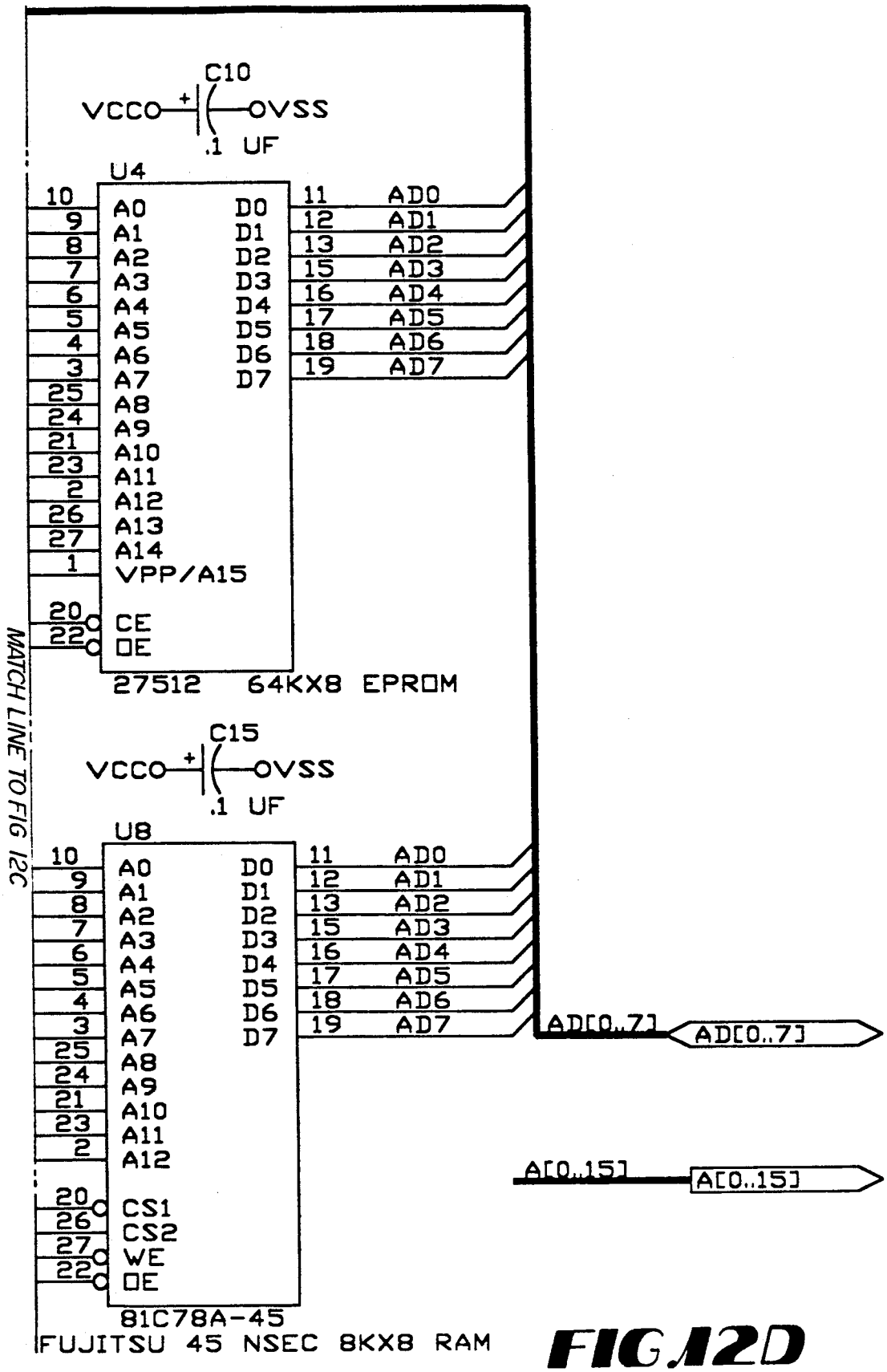
Figure 12E:
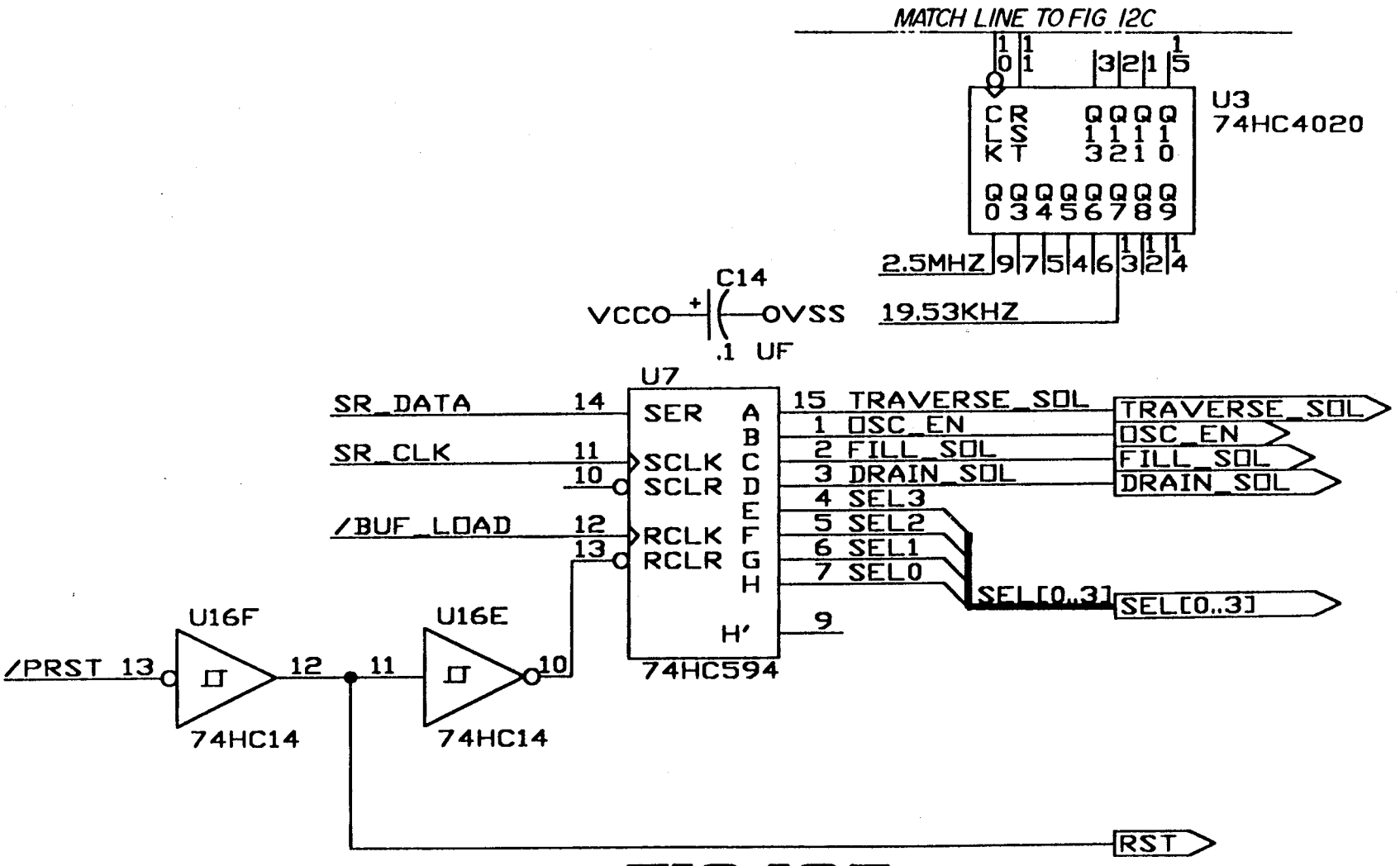
Figure 13:
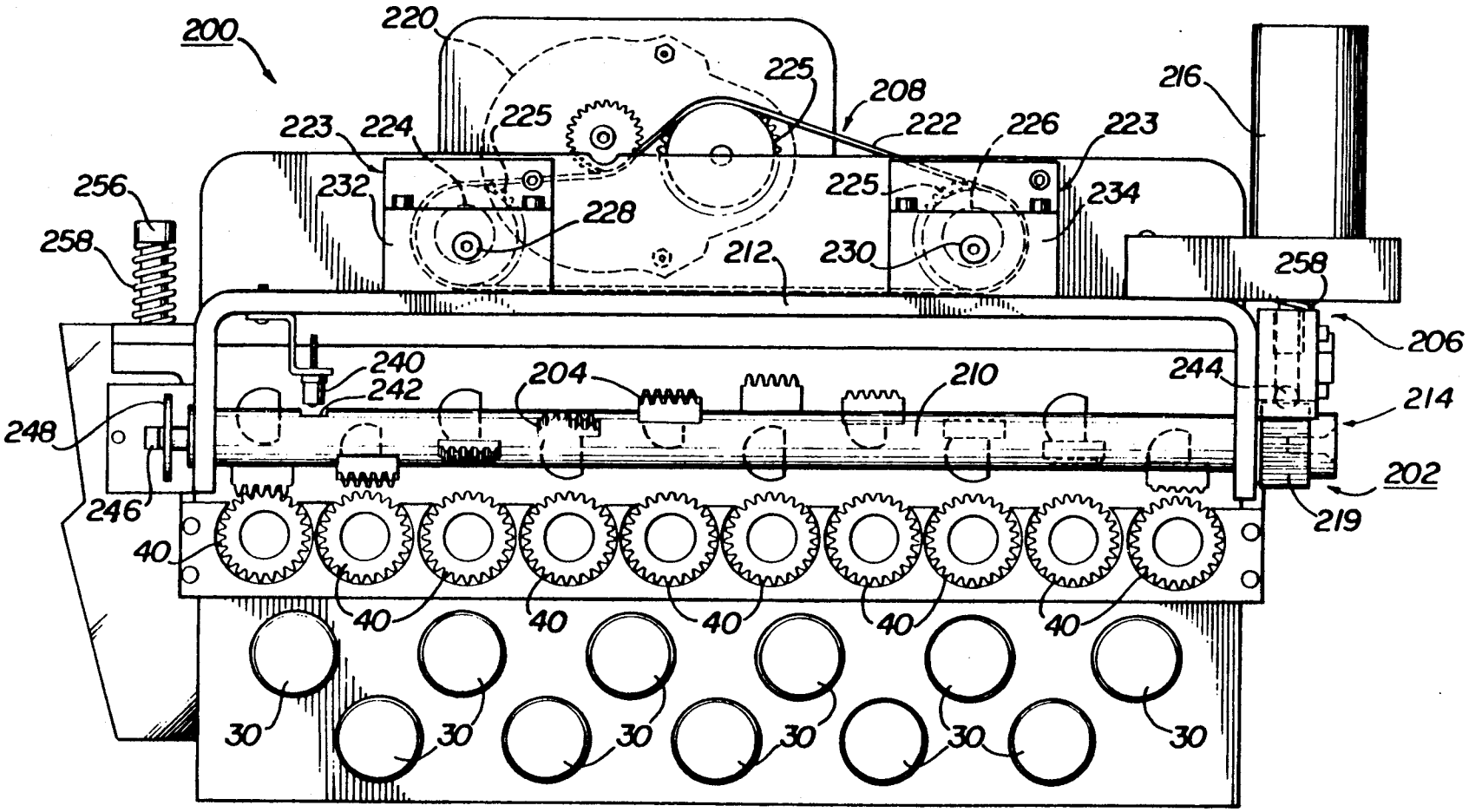
FIG. 13 is a front view of a flow control adjusting mechanism according to a preferred embodiment of the present invention.
Figure 14:
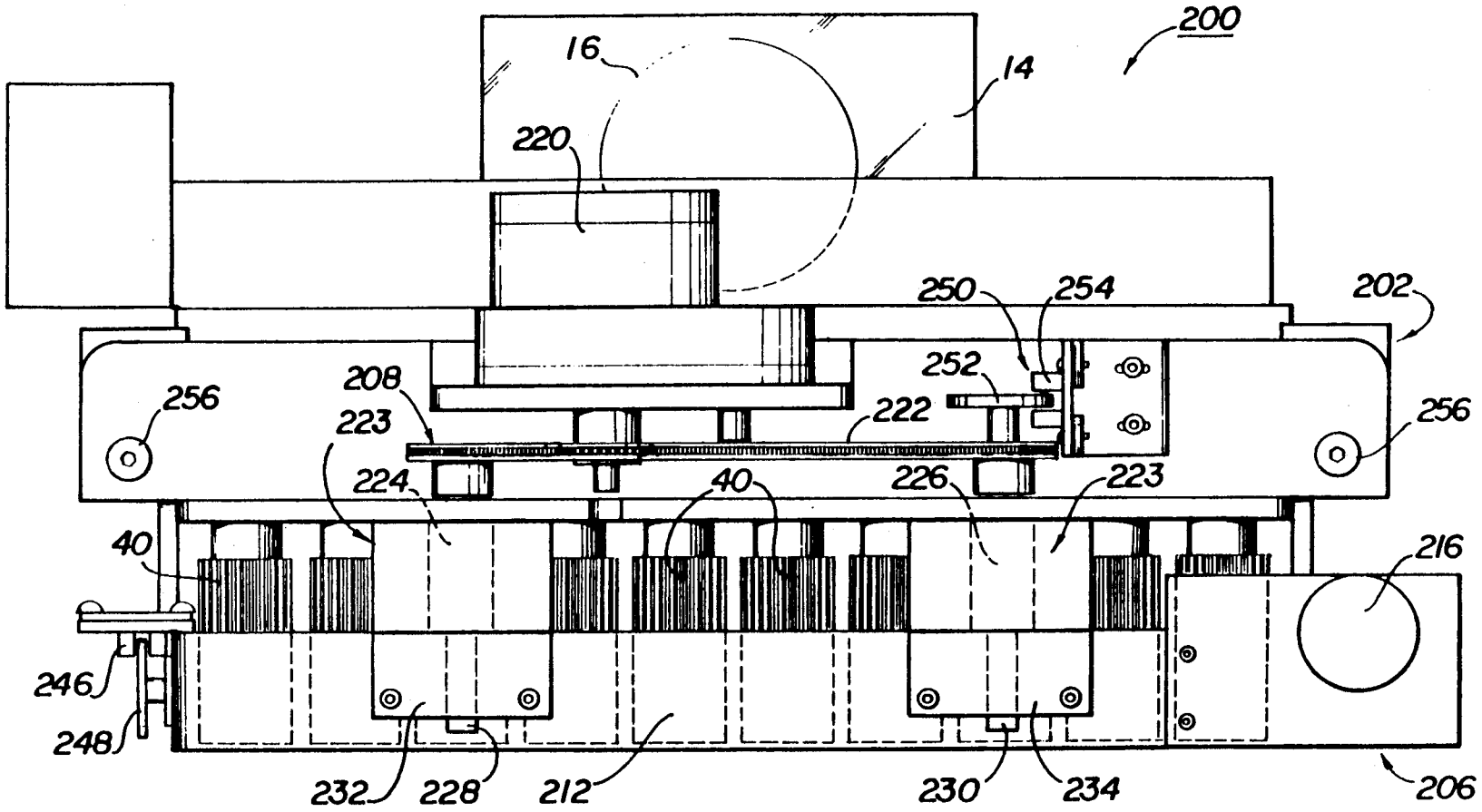
Figure 15:
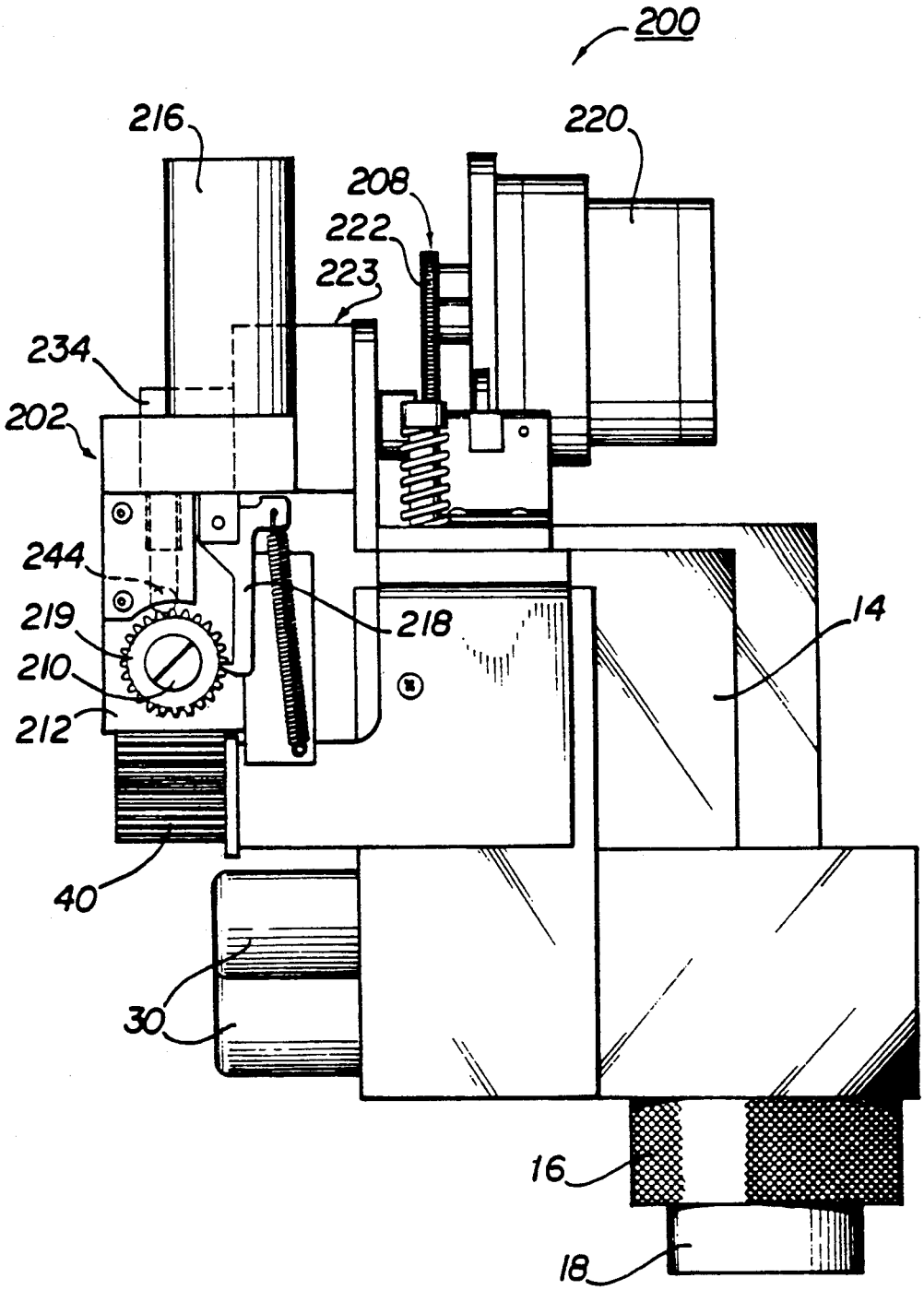
FIG. 15 is an end view of the mechanism of FIG. 13.
Figure 16A:
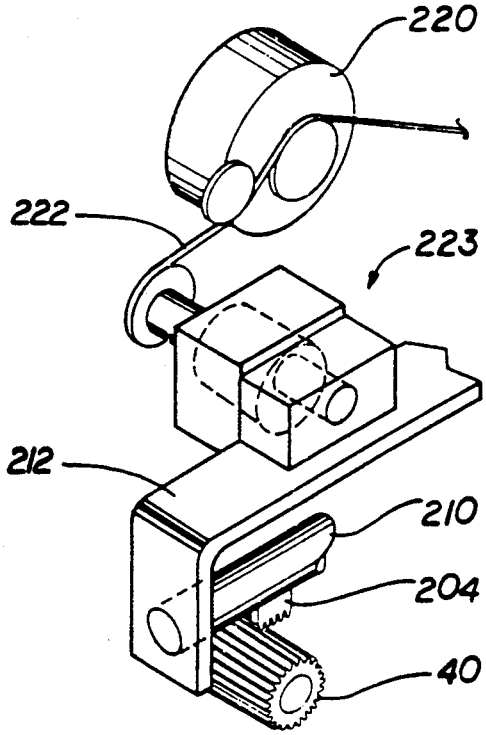
FIGS. 16A–16D are partial isometric views of the mechanism of FIG. 13 showing the operation thereof.
Figure 16B:
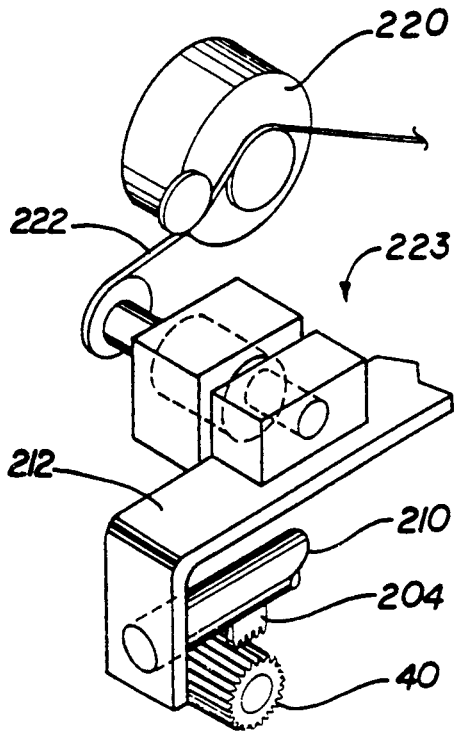
Figure 16C:
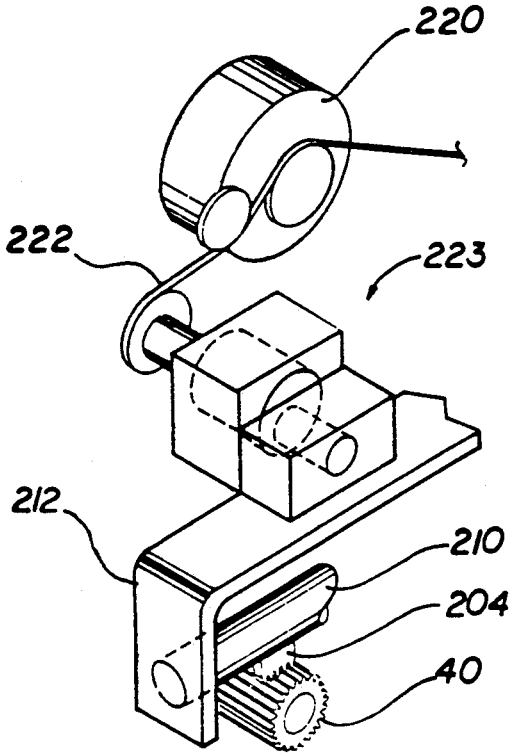
Figure 16D:
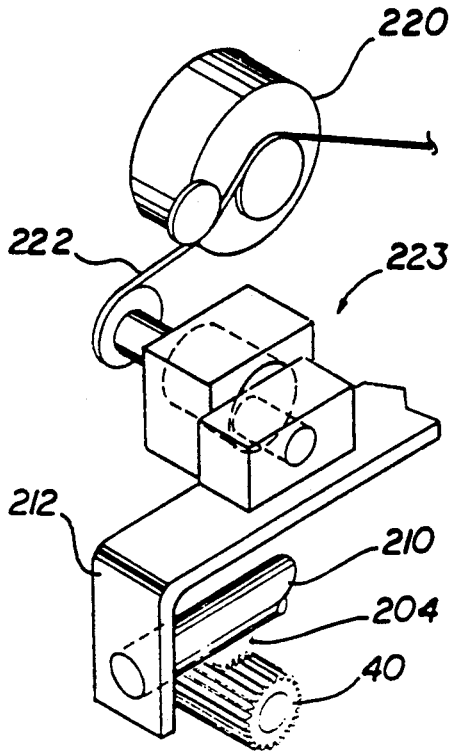

Referring now to FIGS. 11 and 12, the electronics consists of a circuit board with an Intel 80C196 microprocessor that monitors the flowmeters 32 and the drink switches (or receives status information from an operator panel) and controls the adjuster mechanism. There are a total of 17 connectors, ten for the flowmeter input (5 pins: sensor return, pulses, 5V, ground, and thermistor analog), one for the adjuster (16 pins: 24 VDC and phase to the stepper motor, 24 VDC to the solenoid, rotation, in-position, and home sensor power and signal, and ground), three can be dedicated for communication, of which one can be for a serial communication to a store-wide beverage network, one is for a serial communication to an operator panel, and one is for the high speed input port scanner, one connector for a carbonation testing unit (12 pins: 5V, temp and pressure analog signals, solenoid and motor enables, 24 VDC and ground), and two for power to the board (one with 6 pins, +5V, +12V, VSS, AVSS, −12V, and Earth, one with 4 pins, 24 VAC hi, 24 VAC lo, +VM and −VM). The circuit can be described by tracing the inputs and outputs from the processor through five ports as well as a high speed input processor through five ports as well as a high speed input and high speed output. The ports are utilized as follows:

Port 0: Temperature inputs from the selected flavor and water as a drink is being poured, the in-position and home photo sensor signal from the adjuster mechanism, and the interrupt signal from the communication.

Port 1: Port 1 is not used.

Port 2: Receives and transmits serial data;

Port 3 and 4: Address data busses for the 27512 64K EPROM and the 81C78A-45 8K RAM access;

High Speed Input: Receives the selected flavor and water flowmeter pulses, the rotation detector for the adjuster drive chain, and the scan feature.

High Speed Output: Delivers the stepper motor pulses.

Serial data is transmitted to a 74HC594 which generates a four bit flavor select code, three bits sent to an ADG507 multiplexer to select the flavor flowmeter to be connected to the input, one bit sent to an ADG212 multiplexer to select between water and soda flowmeters. Other serial data sent to this IC includes enables for the drivers for the adjuster solenoid.

FIGS. 13–16 show a preferred embodiment of the present invention FIGS. 13–16 show a flow control adjuster 200 that can be used in the dispenser 10 in place of the flow control adjuster 38 described above.

The adjuster 200 includes the flow control sprocket wheel 40 connected through the shaft 41 to each of the flow controls 36, and also includes an actuator 202 for controllably rotating a selected one of the sprocket wheels 40.

The actuator 202 includes a plurality of linear gear racks 204, one for each sprocket wheel, positioning means 206 for moving a selected one of the gear racks 204 into mating contact with its respective flow control sprocket, and drive means 208 for moving the selected gear rack and in turn the flow control sprocket, a desired amount.

The gear racks 204 are mounted in circumferentially and longitudinally different locations along a multi-rack adjusting shaft 210 mounted for rotation in a bracket 212. The shaft 210 is rotated the desired amount to position a selected gear rack in contact with a selected flow control sprocket by a selector means 14 including a solenoid 216, a ratchet arm 218, and a shaft positioning gear 219. Each actuation of the solenoid 216 turns the shaft 210 one position.

After the selected gear rack is in contact with the selected flow control sprocket, the gear rack 204 is moved in an eccentric manner to rotate the flow control sprocket the desired amount by the drive means 208. The drive means 208 includes a motor 220 and a drive chain 222 connected to an eccentric mechanism 223, which includes sprockets 225 for turning two shafts 224 and 226. Each shaft is connected in turn to an eccentric shaft 228 and 230 mounted for rotation in eccentric blocks 232 and 234. The blocks are attached to the bracket 212 that holds the shaft 210, to cause eccentric and reciprocating movement thereof such that the selected gear rack moves in an eccentric path. When the motor 220 turns in one direction, the selected gear rack moves in one direction (such as to the left in FIGS. 16C and D) so as to rotate the flow control sprocket and when it moves in the other direction (such as to the right in FIGS. 16A and B) it is moving out of contact with the flow control sprocket. When the motor 220 turns in the opposite direction, the opposite is true.

The adjuster 200 remains at the home position until an adjustment is needed. Home is recognized by the use of a photosensor 240 that reflects off a flat section 242 of the multi-rack adjusting shaft 210. Home position is also the position required for adjusting the leftmost flow control. When an adjustment is needed on one of the other flow controls, the following occurs.

The solenoid 216 actuates "x" times, causing the multi-rack adjusting shaft 210 to rotate such that the piece of gear rack for flow control "x+1" is in the downmost position. The solenoid actuation causes the ratchet arm 218 to grab the positioning gear 219 and pull the shaft 210 around. The gear 219 has a detent 244 to lock the shaft 210 in position. Various detents can be used, however, the preferred one is a ball held in a tube and spring biased against the gear 219. The shaft 210 only rotates in one direction (counterclockwise as viewed in FIG. 15). There is a position sensor 246 on the other end of the shaft 210 to ensure that each time the solenoid 216 is actuated, the shaft 210 actually moves. The position sensor 246 includes an encoder 248 that alternates dark and light to be sensed each time the solenoid 216 is actuated (i.e. position 2 light, position 3 dark, position 4 light, etc).

Once the shaft 210 is properly positioned, the motor 220 (which can be a stepper motor or a simple bi-directional dc motor) is powered and the drive chain 222 moves the eccentric mechanism 223 via drive sprockets 225 that causes the multi-rack adjusting shaft 210 and all of the associated bracket and hardware to move in an eccentric motion. The bottom part of this motion causes the selected gear rack 204 to come into mating contact with the selected flow control gear sprocket 40 and moves the sprocket one tooth either clockwise or counterclockwise, depending on the motor direction. An eccentric rotation sensor 250 consists of an encoder 252 with a single slot that permits a light sensor 254 to detect a single point of the complete rotation (in the current design this senses the uppermost position of the eccentric rotation). The motor 220 would remain energized until the rotation sensor 250 "sees" the number of rotations corresponding to the magnitude of adjustment that is desired.

When the adjustment is completed, the solenoid 216 energizes until the racked shaft 210 is back at the home position.

The adjuster 200 attaches to the valve 142 at only two locations, by means of two attachment screws 256 with relief springs 258. The purpose of the springs 258 is to allow play in the eccentric motion in case the rack piece does not engage cleanly with the gear sprocket of the flow control. In the case when the two meet tooth to tooth, the spring would allow the rack to ride up until the eccentric path brings the rack around enough to drop down and engage.

Each flow control is equipped with a gear sprocket as with the previously described design. A sprocket aligning rack is used to keep the sprockets in a single line.

This embodiment allows much more access to the valve components for maintenance. Tolerances are less important to the operation of this adjuster mechanism 200. Another feature of this embodiment is the exacting adjustment procedure. Every time the eccentric goes through one complete motion, the flow control is moved exactly one tooth. Further, this embodiment has fewer pieces, is easier to assemble and will be less expensive than the previously described embodiment.

While the preferred embodiment of this invention has been described above in detail, it is to be understood that variations and modifications can be made therein without departing from the spirit and scope of the present invention. For example, it is noted that a separate stepper motor can be used with each of a plurality of flow controls, rather than using a single stepper motor for a plurality of flow controls.

What is claimed is:

1. Apparatus comprising:

(a) a post-mix beverage dispenser including a beverage dispenser valve having separate syrup and water conduits, a solenoid controlled on-off valve in each of said conduits, and an adjustable, piston/-sleeve, pressure compensating flow control in each of said conduits;

(b) means for measuring the flow rate through each of said conduits;

(c) means for automatically comparing each of said measured flow rates with a preferred flow rate;

(d) means for automatically adjusting a selected one of said flow controls a selected amount in response to said comparing means;

(e) wherein said adjusting means includes a flow control sprocket wheel connected to each of said flow controls and for rotating a selected one of said sprocket wheels a selected amount to adjust the flow control connected to said selected sprocket wheel; and (f) wherein said comparing means includes means for detecting a flow error trend over a plurality of separate pours.

2. Apparatus comprising:

(a) a post-mix beverage dispenser including a beverage dispenser valve having separate syrup and water conduits, a solenoid controlled on-off valve in each of said conduits, and an adjustable flow control in each of said conduits;

(b) means for measuring the flow rate through each of said conduits;

(c) means for automatically comparing each of said measured flow rates with a preferred flow rate;

(d) means for automatically adjusting a selected one of said flow controls a selected amount in response to said comparing means; and (e) wherein said beverage dispenser valve is a multi-flavor valve including a plurality of separate syrup conduits, including a flow control sprocket wheel connected to the adjustable flow control on each of said syrup and water conduits, a single drive sprocket wheel for mating engagement with any one of said flow control sprocket wheels, means for moving said drive sprocket wheel into mating contact with any one of said flow control sprocket wheels and means for turning said drive sprocket wheel a selected amount to adjust the flow control connected thereto.

3. The apparatus as recited in claim 2 including positioning means to move said carriage into locked position with said drive sprocket wheel in mating engagement with a selected one of said flow control sprocket wheels and drive means for turning said drive sprocket wheel when in mating engagement with a selected flow control sprocket wheel to adjust the associated flow control a desired amount.

4. The apparatus as recited in claim 3 wherein said positioning means and said drive means include a stepper motor, a drive belt, a movable carriage carrying said drive sprocket wheel, and a solenoid on said carriage for moving said drive sprocket wheel out of engagement with any one of said flow control sprocket wheels and for locking said drive belt to said drive sprocket wheel for moving said carriage and a spring for returning said drive wheel sprocket into engagement with a selected flow control sprocket wheel when the solenoid is de-energized.

5. The apparatus as recited in claim 2 wherein said means for moving said single drive socket wheel include a stationary support, a movable carriage carrying said single drive socket wheel, said stationary support including a stepper drive motor, a drive chain, an encoder, an encoder photosensor adapted to read said encoder, a locking rail with a plurality of locking pin detents to lock said carriage in any one of a number of selected actuating positions, a position rail with a plurality of position holes for locating a selected position, a plurality of carriage guide rods, and a home position photo detector, said movable carriage including a carriage body, a pair of guide blocks slideably mounted on said guide rods, a drive sprocket wheel mounted on a movable slide having a flow control adjustment position and a carriage travel position, said drive sprocket wheel being in mating engagement with a flow control sprocket wheel in said adjustment position and being out of such engagement in said travel position, a solenoid for moving said slide from said adjustment position to said travel position against the action of a spring holding said slide in said adjustment position, a position seeking photo detector position to sense said position holes in said position rail, a home position sensor tab, and a locking pin mounted on a locking pin slide.

6. Apparatus comprising:

(a) a post-mix beverage dispenser including a beverage dispenser valve having separate syrup and water conduits, a solenoid controlled on-off valve in each of said conduits, and an adjustable flow control in each of said conduits;

(b) means for measuring the flow rate through each of said conduits;

(c) means for automatically comparing each of said measured flow rates with a preferred flow rate;

(d) means for automatically adjusting a selected one of said flow controls a selected amount n response to said comparing means; and (e) wherein said beverage dispenser valve is a multi-flavor valve including a plurality of separate syrup conduits, including a flow control sprocket wheel connected to the adjustable flow control on each of said syrup and water conduits, a plurality of linear gear racks circumferentially and longitudinally spaced-apart on a rotatble multi-rack adjusting shaft adjacent said flow control sprocket wheel and positioning means for rotating said gear rack shaft a selected amount to position a selected one of said gear racks in position in mating engagement with a selected one of said flow control socket wheels, and drive means for moving said gear rack shaft longitudinally to turn the engaged flow control sprocket wheel a selected amount to adjust the flow control connected thereto.

7. The apparatus as recited in claim 6 wherein said positioning means includes a solenoid operated ratchet arm for rotating said gear rack shaft a selected amount.

8. The apparatus as recited in claim 6 wherein said drive means for moving said gear rack shaft longitudinally includes a motor, a drive chain, a pair of drive sprockets connected to said drive chain, and an eccentric mechanism for moving said gear rack in an eccentric motion including one portion in which said selected gear rack is in mating contact with a selected one of said flow control sprocket wheels.

9. Apparatus for controlling the ratio of syrup to water in a beverage dispensed form a post-mix beverage dispenser comprising:

(a) a beverage dispensing valve system having separate syrup and water conduits extending therethrough, a solenoid controlled on-off valve in each of said conduits, and an adjustable flow control in each of said conduits;

(b) means for measuring the flow rate through each of said conduits;

(c) means for automatically comparing the measured flow rates with preferred flow rates;

(d) means responsive to said comparing means for automatically adjusting a selected one of said flow controls a selected amount; and (e) wherein said beverage dispenser valve is a multi-flavor valve including a plurality of separate syrup conduits, including a flow control sprocket wheel connected to the adjustable flow control on each of said syrup and water conduits, a single drive sprocket wheel for mating engagement with any one of said flow control sprocket wheels, means for moving said drive sprocket wheel into mating contact with any one of said flow control sprocket wheels and means for turning said drive sprocket wheel a selected amount to adjust the flow control connected thereto.

10. The apparatus as recited in claim 9 including positioning means to move said carriage into locked position with said drive sprocket wheel in mating engagement with a selected one of said flow control sprocket wheels and drive means for turning said drive sprocket wheel when in mating engagement with a selected flow control sprocket wheel to adjust the associated flow control a desired amount.

11. The apparatus as recited in claim 10 wherein said positioning means and said drive means include a stepper motor, a drive belt, a movable carriage carrying said drive sprocket wheel, and a solenoid on said carriage for moving said drive sprocket wheel out of engagement with any one of said flow control sprocket wheels and for locking said drive belt to said drive sprocket wheel for moving said carriage and a spring for returning said drive wheel sprocket into engagement with a selected flow control sprocket wheel when the solenoid is de-energized.

12. The apparatus as recited in claim 11 wherein said means for moving said single drive socket wheel include a stationary support, a movable carriage carrying said single drive socket wheel, said stationary support including a stepper drive motor, a drive chain, an encoder, an encoder photosensor adapted to read said encoder, a locking rail with a plurality of locking pin detents to lock said carriage in any one of a number of selected actuating positions, a position rail with a plurality of position holes for locating a selected position, a plurality of carriage guide rods, and a home position photo detector, said movable carriage including a carriage body, a pair of guide blocks slideably mounted on said guide rods, a drive sprocket wheel mounted on a movable slide having a flow control adjustment position and a carriage travel position, said drive sprocket wheel being in mating engagement with a flow control sprocket wheel in said adjustment position and being out of such engagement in said travel position, a solenoid for moving said slide from said adjustment position to said travel position against the action of a spring holding said slide in said adjustment position, a position seeking photo detector position to sense said position holes in said position rail, a home position sensor tab, and a locking pin mounted on a locking pin slide.

13. Apparatus for controlling the ratio of syrup to water in a beverage dispensed from a post-mix beverage dispenser comprising:

(a) a beverage dispensing valve system having separate syrup and water conduits extending therethrough, a solenoid controlled on-off valve in each of said conduits, and an adjustable flow control in each of said conduits;

(b) means for measuring the flow rate through each of said conduits;

(c) means for automatically comparing the measured flow rates with preferred flow rates;

(d) means responsive to said comparing means for automatically adjusting a selected one of said flow controls a selected amount; and (e) wherein said beverage dispenser valve is a multi-flavor valve including a plurality of separate syrup conduits, including a flow control sprocket wheel connected to the adjustable flow control on each of said syrup and water conduits, a plurality of linear gear racks circumferentially and longitudinally spaced-apart on a rotatable multi-rack adjusting shaft adjacent said flow control sprocket wheel and positioning means for rotating said gear racks shaft a selected amount to position a selected one of said gear racks in position in mating engagement with a selected one of said flow control socket wheels, and drive means for moving said gear rack shaft longitudinally to turn the engaged flow control sprocket wheel a selected amount to adjust the flow control connected thereto.

14. The apparatus as recited in claim 13 wherein said positioning means includes a solenoid operated ratchet arm for rotating said gear rack shaft a selected amount.

15. The apparatus as recited in claim 14 wherein said drive means for moving said gear rack shaft longitudinally includes a motor, a drive chain, a pair of drive sprockets connected to said drive chain, and an eccentric mechanism for moving said gear rack in an eccentric motion including one portion in which said selected gear rack is in mating contact with a selected one of said flow control sprocket wheels.

* * * * *

UNITED STATES PATENT AND TRADEMARK OFFICE

CERTIFICATE OF CORRECTION

PATENT NO. : 5,192,000

DATED : March 9, 1993

INVENTOR(S) : Wandrick et al.

It is certified that error appears in the above-identified patent and that said Letters Patent is hereby corrected as shown below:

Column 10:
In claim 6, line 58, delete "n" and insert --in-- therefor.

Column 11:
In claim 9, line 20, delete "form" and insert --from-- therefor.

Signed and Sealed this

Nineteenth Day of April, 1994

Bruce Lehman

*Attest:*

BRUCE LEHMAN

*Attesting Officer*

*Commissioner of Patents and Trademarks*